US010145112B2

(12) United States Patent
Martens et al.

(10) Patent No.: US 10,145,112 B2
(45) Date of Patent: Dec. 4, 2018

(54) STRUCTURAL GLASS BEAM ELEMENTS AND CONNECTION SYSTEM

(71) Applicant: UNIVERSITEIT GENT, Ghent (BE)

(72) Inventors: Kenny Martens, Tielt (BE); Jan Belis, Sinaai (BE); Robby Caspeele, Overmere (BE)

(73) Assignee: UNIVERSITEIT GENT, Ghent (BE)

( * ) Notice: Subject to any disclaimer, the term of this patent is extended or adjusted under 35 U.S.C. 154(b) by 0 days.

(21) Appl. No.: 15/631,288

(22) Filed: Jun. 23, 2017

(65) Prior Publication Data

US 2017/0370102 A1 Dec. 28, 2017

Related U.S. Application Data

(60) Provisional application No. 62/354,259, filed on Jun. 24, 2016.

(51) Int. Cl.

| | |
|---|---|
| ***E04C 3/28*** | (2006.01) |
| ***E04C 3/30*** | (2006.01) |
| ***E04C 2/54*** | (2006.01) |
| *E04C 3/32* | (2006.01) |
| *E04C 3/36* | (2006.01) |
| *E04C 3/46* | (2006.01) |

(52) U.S. Cl.

CPC ..... *E04C 3/285* (2013.01); *E04C 3/30* (2013.01); *E04C 2/54* (2013.01); *E04C 3/32* (2013.01); *E04C 3/36* (2013.01); *E04C 3/46* (2013.01)

(58) Field of Classification Search

CPC ... E04C 3/285; E04C 3/30; E04C 3/32; E04C 3/46; E04C 3/36; E04C 2/54

See application file for complete search history.

(56) References Cited

U.S. PATENT DOCUMENTS

| | | | | | |
|---|---|---|---|---|---|
| 2,124,799 | A * | 7/1938 | Specht | E04C 1/42 | 52/308 |
| 3,206,901 | A * | 9/1965 | Bakke | E04B 2/96 | 52/235 |
| 4,458,464 | A * | 7/1984 | Borghetto | E04C 1/42 | 52/477 |
| 4,592,175 | A * | 6/1986 | Werner | E04H 1/04 | 52/79.9 |

(Continued)

OTHER PUBLICATIONS

International Search Report and Written Opinion From PCT Application No. PCT/EP2017/065580, dated Sep. 6, 2017.

(Continued)

*Primary Examiner* — Jeanette E Chapman

(74) *Attorney, Agent, or Firm* — Workman Nydegger

(57) ABSTRACT

A glass beam element, for constructing a loadbearing structure, comprises at least one elongate structural reinforcement section extending along a longitudinal direction, and at least one glass segment bonded to said at least one elongate structural reinforcement section. The at least one elongate structural reinforcement section comprises a weldable material, and the at least one glass segment has a length along the longitudinal direction that is shorter than the elongate structural reinforcement section such as to allow welding of an end region of the at least one elongate structural reinforcement section without thereby damaging the at least one glass segment.

17 Claims, 23 Drawing Sheets

(56) References Cited

U.S. PATENT DOCUMENTS

| | | | | |
|---|---|---|---|---|
| 4,899,508 | A * | 2/1990 | Biebuyck | E04B 2/962 52/235 |
| 5,269,161 | A * | 12/1993 | Stillwagon | E05B 5/003 70/208 |
| 2001/0023562 | A1* | 9/2001 | Blobaum | B32B 17/10293 52/235 |
| 2005/0055941 | A1 | 3/2005 | Vogler | |
| 2007/0209301 | A1* | 9/2007 | Memari | E04B 2/96 52/204.5 |
| 2013/0089710 | A1* | 4/2013 | Thiagarajan | E04C 2/543 428/172 |
| 2015/0121802 | A1 | 5/2015 | Veer | |
| 2016/0160515 | A1* | 6/2016 | Wallance | E04B 1/3483 52/79.1 |

OTHER PUBLICATIONS

Demuynck, "Numerical Investigation into Connection Possibilities Between Structural Glass Beams", Master's Dissertation, Department of Structural Engineering, Universiteit Gent, 2015, 186 Pages.

Louter et al., "Experimental Research on Scale 1:4 Models of an 18m Reinforced Glass Beam, Part 1", Glass Performance Days, 2007, pp. 87-92.

Louter, "Fragile yet Ductile: Structural Aspects of Reinforced Glass Beams", Apr. 18, 2011, 325 Pages.

European Search Report from EP Application No. 16182413.1, dated Dec. 16, 2016.

* cited by examiner

STRUCTURAL GLASS BEAM ELEMENTS AND CONNECTION SYSTEM

FIELD OF THE INVENTION

The invention relates to the field of glass elements for loadbearing glass construction. More specifically it relates to a glass beam element, a loadbearing structure comprising such elements and a method for connecting glass beam elements.

BACKGROUND OF THE INVENTION

In architecture, high transparency may be considered a desirable aesthetic quality of particular buildings and structures. In providing a glass construction, e.g. a loadbearing glass construction of glass elements, it may be preferable to maintain the transparency of the construction over as much of the area covered by the construction as possible, e.g. for aesthetic reasons. For example, in contemporary architecture, it may be preferred to provide transparent buildings, floors and/or walls.

Such high transparency may for example be applied in glazed façades and structural members, such as beams, columns, floors and roofs, constructed out of glass. As a result, glass may not only have a passive function in architecture, but also have an active, load-carrying function.

Nonetheless, glass is a brittle material, which may lead to unsafe failure behaviour. Key members such as structural beams are required to be robust, which means they should exert a gradual failure behaviour accompanied with relatively large deformations. For the case of structural glass beams, this can be translated into post-breakage strength and ductility. Conventional glass beams, as known in the art, e.g. comprising laminated glass, may have a brittle failure behaviour. Therefore, in order to increase their structural safety, redundancy must equally be increased, thus leading to an excessive, and costly, glass usage.

However, currently, practical applications may be mostly limited to relatively small spans and statically determinate support conditions. Nevertheless, it may be an aim in the architectural arts to construct large parts of a structure out of glass to create ever more transparent buildings, e.g. glass façades, floor and roof systems, or large-scale greenhouses.

Hybrid glass beam concepts, such as composite glass beams and reinforced glass beams, are known in the art in which glass is combined with another material, e.g. to improve post-breakage strength and ductility. Such structural glass beams may thus achieve a safer failure behaviour. Among these hybrid concepts, the stainless steel-reinforced glass beam, bearing some similarity to reinforced concrete, has proven to be relatively easily implementable in practice.

Particularly the steel reinforced glass beam, which may have been developed similar to reinforced concrete, may have advantageous properties. In this type, a small metal section, such as for example a steel alloy section, is added at the tensile edge of the glass beam, such as to serve as a crack bridge in case of glass fracture, transferring the loads between two intact glass zones, giving the beam post-breakage load-carrying capacity. Furthermore, the reinforcement is able to yield which gives the beam a ductile ultimate failure behaviour. Therefore, this type of hybrid glass beam may be particularly suitable as a bearing structural member.

To achieve a particularly transparent structure, entire systems of structural members should be preferably made of glass. For glass beam constructions, this may also imply a need for safe butt connections. Such beam system may, for example, be used to carry an entire floor or roof, to form a top-down glazed façade laterally supported by glass fins or to form simply a large-span glass beam.

The production process, e.g. autoclave dimensions, and transport may impose limits on the length of the beams. Several methods are known in the art for connecting such glass beams. Since dimensional limits are imposed by production and transportation, as well as by efficiency of on-site handling, a glass beam system in which glass beams are butt connected by safe connections may be preferable to construct such large scale spans.

A first kind of known connection approach is characterized by a steel member to which both glass beams are connected through bolts. In some prior art approaches, the steel member may be embedded in the interlayer of the glass laminate. However, such approaches may disadvantageously affect the overall transparency of the resulting beam negatively. Furthermore, a bolted connection may impose stress concentrations in the glass, while an embedment into the laminate may require all stresses to be transferred through the weaker interlayer, which mechanical properties highly depend on environmental conditions such as temperature and load duration.

Another approach known in the art is to create segmented glass beams, e.g. splice connected glass beams or glass beams connected by splice connections, in which the glass web exists out of multiple glass plies in its thickness and length direction. The segmentation scheme is typically chosen so that every section has a predefined amount of continuous glass panes. However, for beams with large span, this solution will lead either to a disadvantageous on-site production process, or to a very expensive and inefficient transportation procedure.

For example, a combination of a connector for glass elements and such glass elements to provide a loadbearing glass construction is known from US2005/0055941, in which a connection method is disclosed that comprises fitting a first fitting to a first loadbearing glass component, a second fitting to a second loadbearing glass component, and providing a glass load transmitting element between the first fitting and the second fitting.

In another prior-art example, US 2015/121802 also discloses a glass construction that comprises at least one glass post and at least one glass beam that are arranged adjacent to each other. A connector provides a rotationally fixed connection between the post and the beam. Along at least a part of the edges of the glass elements, reinforcement elements are provided that are connected to the connector by cooperating protrusions and receptacles.

SUMMARY OF THE INVENTION

It is an object of embodiments of the present invention to provide good and efficient means and methods for constructing loadbearing structures from glass beam elements.

The above objective is accomplished by a method and device according to the present invention.

It is an advantage of embodiments of the present invention that two glass beam elements, e.g. two structural glass beams, can be connected such as to abut each other, thereby forming a continuous compound loadbearing structure of good strength, stiffness, integrity and fail-safe behavior.

For example, good structural safety can be provided by a glass beam element, as well as a loadbearing structure, in accordance with embodiments of the present invention. On the element level, reinforcements may advantageously provide post-fracture capacity for the glass beam element as such. On the structural system level, e.g. the level of the assembled loadbearing structure, safety may be incorporated by advantageously connecting the reinforcements of abutting beams. Furthermore, a connection between beam elements in accordance with embodiments of the present invention may form a plastic hinge before ultimate collapse would occur, thus triggering moment redistribution in statically indeterminate beam systems, and thus advantageously providing system safety (which may be required for large-scale structures due to building codes).

It is an advantage of embodiments of the present invention that a loadbearing structure can be constructed from at least two glass beam elements that are interconnected in a structurally safe manner, e.g. by enabling plastic hinge formation. For example, a loadbearing structure in accordance with embodiments of the present invention may fail in a gradual, ductile and safe manner when overloaded.

It is an advantage of embodiments of the present invention that a loadbearing structure can be constructed from at least two glass beam elements without requiring drilling holes in the glass, e.g. and therefore also not requiring an expensive heat treatment following such drilling. For example, it is known that drilling holes in glass may be detrimental to the structural performance due to a high sensitivity of glass to surface damage and stress concentrations.

It is an advantage of embodiments of the present invention that a loadbearing structure can be constructed from at least two glass beam elements without requiring bolts to connect parts thereof. It is a disadvantage of such bolted connections, as used in similar loadbearing structures known in the art, that stress transfer may be concentrated through bolts which are provided in structurally weakened regions of the glass due to the drilling of holes for accommodating the bolts.

It is an advantage of embodiments of the present invention that connectors, such as metal plates, e.g. metal plates in combination with bolted connections, are not required for connecting glass beam elements into compound loadbearing structures. For example, it may be known to provide metal plates, e.g. steel plates, where bolts are provided through holes in the glass to connect the separate glass elements, e.g. such as to enable a transfer of forces between those glass elements, while preventing failure of the connection in a brittle way, e.g. thereby tearing the bolts out of the glass laminate in a sudden and highly energetic manner. However, while such metal plate may yield to prevent such sudden failure, a substantial area of the structure, where the metal plates are provided, may be disadvantageously opaque.

It is an advantage of embodiments of the present invention that a high degree of transparency can be maintained over a large area of a loadbearing structure. Particularly, a connection between two glass beam elements may not require additional opaque elements. Furthermore, a connection between glass beam elements may be provided that is substantially indistinguishable, e.g. under casual visual inspection, from a similar continuous glass beam element having the combined length.

For example, an overall beam structure of connected beam segments may visually appear uninterrupted at the connections, e.g. except for negligible glass pane contact seams, thus enhancing the aesthetics of the beam system.

It is an advantage of embodiments of the present invention that hollow profile reinforcements may be interconnected such that a continuous duct is maintained along the beam system. Therefore, such duct may be advantageously used for integrating electrical wiring or fluid conduits, e.g. for cooling systems and/or water flow sprinklers.

It is an advantage of embodiments of the present invention that a good distribution of mechanical and/or thermal stresses, e.g. a good stress transfer, can be achieved over a large area of a loadbearing structure. Particularly, it is an advantage that such stress transfer is not concentrated in relatively small connective elements, e.g. in relatively small bolts and/or metal connectors.

It is an advantage of embodiments of the present invention that a good stress transfer can be provided in parallel by different connective mechanisms, e.g. such that one mechanism may provide a failsafe for mitigating stresses when the other mechanism reaches a failure mode. For example, a residual load-transfer mechanism may be provided, e.g. through welded connections, in addition to an adhesive connection of glass panes. Therefore, a redundant connection system is advantageously provided. Furthermore, an ultimate capacity of the loadbearing structure may be provided that is higher than an initial glass fracture load.

It is an advantage of embodiments of the present invention that a structurally sound loadbearing structure can be constructed, e.g. on-site, from prefabricated glass beam elements. It is a further advantage that such glass beam elements may have a length, e.g. a sufficiently short length, that allows easy production, transportation and on-site handling of the beam, yet can be easily combined in a loadbearing structure that is safe and strong.

It is another advantage of embodiments of the present invention that a beam system can be optimized, e.g. tuned, for each specific application, for example by positioning seams close to the inflection points of the bending moment line. A connection system as described in relation to embodiments of the present invention may enable the designer to design the beam system according to prescribed requirements of the customer.

It is another advantage of a method in accordance with embodiments of the present invention that the connection of glass beam elements can be entirely executed on-site. Moreover, no unwieldly large prefabricated beams may be necessary to build the beam system, e.g. thus enhancing the on-site maneuverability during execution.

It is another advantage of embodiments of the present invention that beam elements can be manufactured without incurring a cost and/or losing time on the drilling of holes in glass panes and the accompanying tempering process. Furthermore, production of the reinforced glass beam elements may be easily integrated in a standard lamination line, e.g. without requiring particularly expensive and large autoclaves.

In a first aspect, the present invention provides a glass beam element for constructing a loadbearing structure. The glass beam element comprises at least one elongate structural reinforcement section extending along a longitudinal direction, and at least one glass segment bonded to the at least one elongate structural reinforcement section. The at least one elongate structural reinforcement section comprises a weldable material. The at least one glass segment has a length along the longitudinal direction that is shorter than the elongate structural reinforcement section such as to allow welding of an end region of the at least one elongate structural reinforcement section without thereby damaging the at least one glass segment.

In a glass beam element in accordance with embodiments of the present invention, the at least one structural reinforcement section may extend for a distance beyond the at least one glass segment in at least one sense of the longitudinal direction.

In a glass beam element in accordance with embodiments of the present invention, this distance may be at least 4 times a largest diameter of a cross section of the structural reinforcement section, e.g. at least 8 times a largest diameter of a cross section of the structural reinforcement section, in which the cross section is perpendicular to the longitudinal direction.

In a glass beam segment in accordance with embodiments of the present invention, the at least one glass segment may comprise at least two glass panes stacked in a direction perpendicular to the longitudinal direction and having different lengths in the longitudinal direction.

In a glass beam element in accordance with embodiments of the present invention, the at least one glass segment may comprise one internal glass pane and two external glass panes, in which the at least one internal glass pane is provided in between the two external glass panes.

In a glass beam element in accordance with embodiments of the present invention, the cross section of the reinforcement may have a solid rectangular shape or may have a hollow rectangular shape. The distance referred to hereinabove may be at least 5 times a length of an edge of the rectangular shape, e.g. at least 10 times a length of an edge of the rectangular shape.

Alternatively, in a glass beam element in accordance with embodiments of the present invention, the cross section of the reinforcement may have a solid or hollow shape that is circular.

In a glass beam element in accordance with embodiments of the present invention, the at least one glass segment may be bonded to the at least one elongate structural reinforcement section in a tensile zone and/or a pressure zone of the glass segment.

In a glass beam element in accordance with embodiments of the present invention, the at least one glass segment may be bonded to the at least one elongate structural reinforcement section in a region of the glass beam element that comprises at least part of an edge of the glass segment. The glass segment may have a rectangular planar shape and the edge may correspond to a long edge of the rectangular planar shape.

In a glass beam element in accordance with embodiments of the present invention, the at least one elongate structural reinforcement section may comprise two parallel elongate structural reinforcement sections extending along the longitudinal direction. The at least one glass segment may be bonded along both long edges of the rectangular planar shape to respectively the two elongate structural reinforcement sections. Each elongate structural reinforcement section may comprise the weldable material. The at least one glass segment may have a length along the longitudinal direction that is shorter than both elongate structural reinforcement sections such as to allow welding of end regions of both elongate structural reinforcement sections without thereby damaging the at least one glass segment.

In a glass beam element in accordance with embodiments of the present invention, the at least one elongate structural reinforcement section may comprise a weldable material. Preferably, the weldable material may be characterized by a ductile failure behavior.

In a glass beam element in accordance with embodiments of the present invention, the at least one elongate structural reinforcement section may comprise a stainless steel section.

In a glass beam element in accordance with embodiments of the present invention, the at least one elongate structural reinforcement section may comprise a weldable fiber reinforced composite, such as a weldable carbon fiber composite.

In a glass beam element in accordance with embodiments of the present invention, the at least one glass segment may comprise a glass laminate.

In a glass beam element in accordance with embodiments of the present invention, the at least one glass segment may comprise at least one internal glass pane and two external glass panes. The at least one internal glass pane may be provided in between the two parallel elongate structural reinforcement sections and in between the two external glass panes. The two external glass panes may furthermore extend over the two elongate structural reinforcement sections such as to position the two elongate structural reinforcement sections in between the two external glass panes.

In a glass beam element in accordance with embodiments of the present invention, the at least one internal glass pane may be longer in the longitudinal direction than each of the two external glass panes.

In a glass beam element in accordance with embodiments of the present invention, the first distance may correspond to a distance that each structural reinforcement section extends beyond the at least one internal glass pane in the longitudinal direction. Each structural reinforcement section may extend beyond each external glass pane in the longitudinal direction over a second distance, in which this second distance is larger than the first distance.

In a second aspect, the present invention provides a method for constructing a loadbearing structure. The method comprises obtaining a first glass beam element in accordance with embodiments of the first aspect of the present invention and a second glass beam element in accordance with embodiments of the first aspect of the present invention. The method further comprises placing the end region of the at least one elongate structural reinforcement section of the first glass beam element such as to abut the end region of the at least one elongate structural reinforcement section of the second glass beam element. The method further comprises welding the end region of the at least one elongate structural reinforcement section of the first glass beam element to the end region of the at least one elongate structural reinforcement section of the second glass element such as to obtain at least one joined elongate structural reinforcement section. The method also comprises bonding at least one connection glass segment to the at least one joined elongate structural reinforcement section such as to form a substantially continuous glass surface, e.g. a perceptually continuous glass surface, formed by the at least one glass segment of the first glass beam element, the at least one connection glass segment and the at least one glass segment of the second glass beam element.

In a method in accordance with embodiments of the present invention, the welding may comprise performing a circumferential weld of hollow profiles of the at least one structural reinforcement sections in the abutting end regions.

In a method in accordance with embodiments of the present invention, a continuous duct for a cable and/or a conduit may be provided throughout the at least one joined elongate structural reinforcement section formed by the circumferential welding of the at least one elongate structural reinforcement sections.

A method in accordance with embodiments of the present invention, may comprise guiding a cable and/or fluid conduit through this duct.

In a method in accordance with embodiments of the present invention, the welding may comprise performing a groove weld of prepared edges of the at least one structural reinforcement sections in the abutting end regions. These prepared edges may comprise corresponding root faces and groove faces. These groove faces may have a bevel angle of about 30 degrees. However, embodiments of the present invention are not limited thereto, and different welding techniques, as known in the art, may be applied and/or different bevel angles may be used, as will be apparent to the person skilled in the art.

A method in accordance with embodiments of the present invention, may further comprise polishing a weld surface produced by the welding before performing the bonding.

In a method in accordance with embodiments of the present invention, the step of obtaining may comprise obtaining a first and a second glass beam element in which for each element:

the at least one glass segment is bonded to the at least one elongate structural reinforcement section in a region of the glass beam element that comprises at least part of an edge of the glass segment;

the glass segment has a rectangular planar shape and the edge corresponds to a long edge of the rectangular planar shape;

the at least one elongate structural reinforcement section comprises two parallel elongate structural reinforcement sections extending along the longitudinal direction;

the at least one glass segment is bonded along both long edges of the rectangular planar shape to respectively the two elongate structural reinforcement sections;

each elongate structural reinforcement section comprises the weldable material; and the at least one glass segment has a length along the longitudinal direction that is shorter than both elongate structural reinforcement sections such as to allow welding of end regions of both elongate structural reinforcement sections without thereby damaging the at least one glass segment.

Furthermore, in such method, the step of placing may comprise placing two first end regions of respectively the two parallel elongate structural reinforcement sections of the first glass beam element such as to respectively abut two second end regions of respectively the two parallel elongate structural reinforcement sections of the second glass beam element. The two first end regions and the two second end regions may be located at a same end of respectively the first glass beam element and the second glass beam element with respect to the longitudinal direction of the corresponding glass beam element.

Furthermore, in such method, the step of welding may comprise welding the two first end regions to respectively the two second end regions such as to obtain two joined elongate structural reinforcement sections.

In a method in accordance with embodiments of the present invention, the step of obtaining may comprise obtaining a first and a second glass beam element in which for each element:

the at least one glass segment is bonded to the at least one elongate structural reinforcement section in a region of the glass beam element that comprises at least part of an edge of the glass segment;

the glass segment has a rectangular planar shape and the edge corresponds to a long edge of the rectangular planar shape;

the at least one elongate structural reinforcement section comprises two parallel elongate structural reinforcement sections extending along the longitudinal direction;

the at least one glass segment is bonded along both long edges of the rectangular planar shape to respectively the two elongate structural reinforcement sections;

each elongate structural reinforcement section comprises the weldable material;

the at least one glass segment has a length along the longitudinal direction that is shorter than both elongate structural reinforcement sections such as to allow welding of end regions of both elongate structural reinforcement sections without thereby damaging the at least one glass segment;

the at least one glass segment comprises an internal glass pane and two external glass panes;

the internal glass pane is provided in between the two parallel elongate structural reinforcement sections and in between the two external glass panes, and the two external glass panes furthermore extend over the two elongate structural reinforcement sections such as to position the two elongate structural reinforcement sections in between the two external glass panes. Furthermore, in such step of obtaining the first and the second glass beam element, for each element, the at least one internal glass pane may be longer in the longitudinal direction than each of the two external glass panes.

In such method, the step of bonding may comprise assembling glass panes by placing an internal connection glass pane in between the internal glass pane of the first glass beam element and the internal glass pane of the second glass beam element and in between the two joined elongate structural reinforcement sections. This assembling may further comprise placing two external connection glass panes respectively on either side of said internal connection glass pane, the two external connection glass panes furthermore extending over the two joined elongate structural reinforcement sections such as to position the two joined elongate structural reinforcement sections in between the two external connection glass panes.

A method in accordance with embodiments of the present invention may further comprise providing an adhesive film in between each external connection glass pane and the at least one internal connection glass pane and/or in between each external connection glass pane and the at least one internal glass panes.

In a method in accordance with embodiments of the present invention, the step of assembling may further comprise spacing the internal connection glass pane away from the at least one internal glass panes of respectively the first and second glass beam element, spacing the external connection glass panes away from the external glass panes of respectively the first and second glass beam element, and spacing the internal connection glass pane away from the external connection glass panes, such as to avoid direct glass to glass contact between the glass panes.

In a method in accordance with embodiments of the present invention, the spacing steps may comprise placing spacers to align and space apart the glass panes.

In a method in accordance with embodiments of the present invention, the step of bonding may further comprise filling spaces in between the assembled glass panes with a liquid adhesive, which these spaces are formed by the spacing.

In a method in accordance with embodiments of the present invention, the liquid adhesive may comprise a cast resin that cures under the influence of ultraviolet radiation.

In a method in accordance with embodiments of the present invention, the bonding may further comprise exposing the assembled glass panes to ultraviolet radiation in order to cure the cast resin.

In a third aspect, the present invention provides a loadbearing structure comprising at least one connection glass segment and at least a first and a second glass beam element in accordance with embodiments of the first aspect of the present invention. In this loadbearing structure, the end region of the at least one elongate structural reinforcement section of the first glass beam element is welded to the end region of the at least one elongate structural reinforcement section of the second glass beam element such as to form at least one joined elongate structural reinforcement section. The at least one connection glass segment is bonded to the at least one joined elongate structural reinforcement section such as to form a substantially continuous glass surface, e.g. a perceptually continuous glass surface, formed by the at least one glass segment of the first glass beam element, the at least one connection glass segment and the at least one glass segment of the second glass beam element.

In a loadbearing structure in accordance with embodiments of the present invention, the at least one joined elongate structural reinforcement section may have a hollow cross section profile such as to form a duct in the joined elongate structural reinforcement section.

A loadbearing structure in accordance with embodiments of the present invention may further comprise a cable and/or conduit running through the duct.

In a loadbearing structure in accordance with embodiments of the present invention, the first and second glass beam element may comprise a first and a second glass beam element, in which for each element:

the at least one glass segment is bonded to the at least one elongate structural reinforcement section in a region of the glass beam element that comprises at least part of an edge of the glass segment;

the glass segment has a rectangular planar shape and the edge corresponds to a long edge of the rectangular planar shape;

the at least one elongate structural reinforcement section comprises two parallel elongate structural reinforcement sections extending along the longitudinal direction;

the at least one glass segment is bonded along both long edges of the rectangular planar shape to respectively the two elongate structural reinforcement sections;

each elongate structural reinforcement section comprises the weldable material; and the at least one glass segment has a length along the longitudinal direction that is shorter than both elongate structural reinforcement sections such as to allow welding of end regions of both elongate structural reinforcement sections without thereby damaging the at least one glass segment.

In such loadbearing structure, two first end regions of respectively the two parallel elongate structural reinforcement sections of the first glass beam element may be welded to respectively two second end regions of respectively the two parallel elongate structural reinforcement sections of the second glass beam element such as to form two joined elongate structural reinforcement sections. The two first end regions and the two second end regions may be at a same end of respectively the first glass beam element and the second glass beam element with respect to the longitudinal direction of the corresponding glass beam element.

In a loadbearing structure in accordance with embodiments of the present invention, for each of the first and second glass beam element may comprise a first and a second glass beam element in which for each element:

the at least one glass segment is bonded to the at least one elongate structural reinforcement section in a region of the glass beam element that comprises at least part of an edge of the glass segment;

the glass segment has a rectangular planar shape and the edge corresponds to a long edge of the rectangular planar shape;

the at least one elongate structural reinforcement section comprises two parallel elongate structural reinforcement sections extending along the longitudinal direction;

the at least one glass segment is bonded along both long edges of the rectangular planar shape to respectively the two elongate structural reinforcement sections;

each elongate structural reinforcement section comprises the weldable material;

the at least one glass segment has a length along the longitudinal direction that is shorter than both elongate structural reinforcement sections such as to allow welding of end regions of both elongate structural reinforcement sections without thereby damaging the at least one glass segment;

the at least one glass segment comprises an internal glass pane and two external glass panes;

the internal glass pane is provided in between the two parallel elongate structural reinforcement sections and in between the two external glass panes, and the two external glass panes furthermore extend over the two elongate structural reinforcement sections such as to position the two elongate structural reinforcement sections in between the two external glass panes. Furthermore, in such loadbearing structure in accordance with embodiments, for each element, the at least one internal glass pane may be longer in the longitudinal direction than each of the two external glass panes.

In such loadbearing structure, the at least one connection glass segment may comprise an internal connection glass pane in between two external connection glass panes. The internal connection glass pane may be located in between the internal glass pane of the first glass beam element and the internal glass pane of the second glass beam element. The internal connection glass pane may be located in between the two joined elongate structural reinforcement sections. The internal connection glass pane may be located in between the two external connection glass panes. The two external connection glass panes may extend over the two joined elongate structural reinforcement sections such as to position the two joined elongate structural reinforcement sections in between the two external connection glass panes.

In a loadbearing structure in accordance with embodiments of the present invention, the internal connection glass pane may be separated from and bonded to the two external connection glass panes by layers of cured resin.

In a loadbearing structure in accordance with embodiments of the present invention, the cured resin may further provide a connection between the internal connection glass pane and respectively the at least one internal glass pane of the first glass beam element and the at least one internal glass pane of the second glass beam element.

In a loadbearing structure in accordance with embodiments of the present invention, the cured resin may further provide a connection between each external connection glass pane and respectively a corresponding external glass pane of the first glass beam element and a corresponding external glass pane of the second glass beam element.

In a loadbearing structure in accordance with embodiments of the present invention, the internal connection glass pane may be separated from and bonded to the two external connection glass panes by layers formed by adhesive films.

Particular and preferred aspects of the invention are set out in the accompanying independent and dependent claims. Features from the dependent claims may be combined with features of the independent claims and with features of other dependent claims as appropriate and not merely as explicitly set out in the claims.

These and other aspects of the invention will be apparent from and elucidated with reference to the embodiment(s) described hereinafter.

Figure 1:
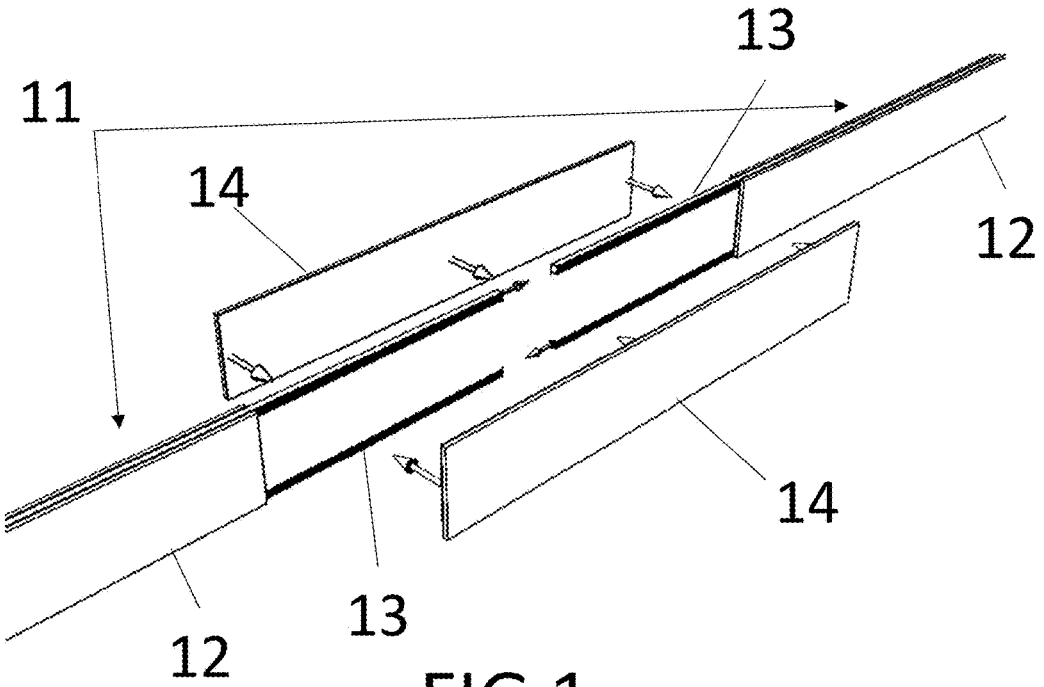
FIG. 1 schematically shows a three-dimensional conceptual view of an exemplary connection between a pair of glass beam elements, relating to an example for illustrating embodiments of the present invention.

The drawings are only schematic and are non-limiting. In the drawings, the size of some of the elements may be exaggerated and not drawn on scale for illustrative purposes.

Any reference signs in the claims shall not be construed as limiting the scope.

In the different drawings, the same reference signs refer to the same or analogous elements.

DETAILED DESCRIPTION OF ILLUSTRATIVE EMBODIMENTS

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, the terms first, second and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms top, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly, it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the invention as could be claimed requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

In a first aspect, the present invention relates to a glass beam element for constructing a loadbearing structure. The glass beam element comprises at least one elongate structural reinforcement section extending along a longitudinal direction, and at least one glass segment bonded to the at least one elongate structural reinforcement section, e.g. in a tensile zone and/or a pressure zone of the at least one glass segment. The at least one elongate structural reinforcement section comprises a weldable material. The at least one glass segment has a length along the longitudinal direction that is shorter than the elongate structural reinforcement section such as to allow welding of an end region of the at least one elongate structural reinforcement section without thereby damaging the at least one glass segment.

Figure 7:
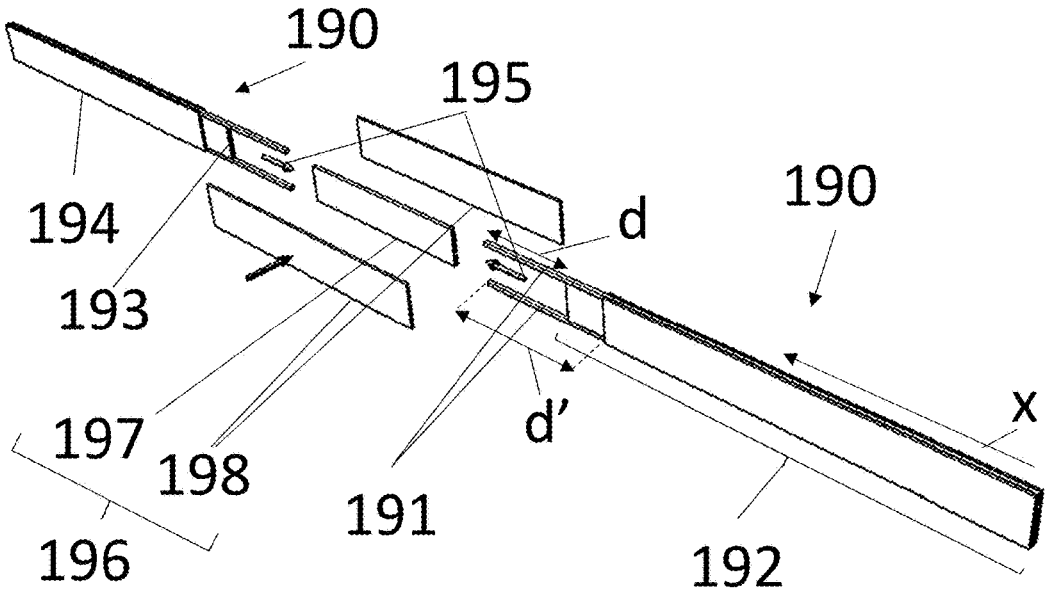
FIG. 7 shows an exemplary glass beam element for constructing a loadbearing structure in accordance with embodiments of the present invention.

Referring to FIG. 7, an exemplary glass beam element 190 for constructing a loadbearing structure in accordance with embodiments of the present invention is shown.

The glass beam element 190 comprises at least one elongate structural reinforcement section 191 extending along a longitudinal direction x.

For example, a plurality of elongate structural reinforcement sections, e.g. two elongate structural reinforcement sections, may be arranged parallel to the longitudinal direction x.

The at least one elongate structural reinforcement section 191 comprises a weldable material. For example, the or each elongate structural reinforcement section may comprise iron or an iron alloy, e.g. a steel, e.g. a stainless steel. In another example, the or each elongate structural reinforcement section may comprise a weldable fiber-reinforced composite, e.g. a carbon fiber composite.

The glass beam element 190 comprises at least one glass segment 192. Particularly, the at least one glass segment may comprise all glass panes or glass elements of the glass beam element 190 that, in combination, cover a substantial area of a plane parallel to the longitudinal direction x of the reinforcement section(s).

The glass segment or each glass segment may have a rectangular planar shape. For example, the at least one glass segment may comprise a stack of glass panes, e.g. a glass laminate structure.

Particularly, in embodiments according to the present invention, the at least one glass segment may comprise a glass laminate.

The glass segment 192 is bonded to the at least one elongate structural reinforcement section 191, e.g. in a tensile zone and/or a pressure zone of the glass segment.

The at least one glass segment 192, e.g. the glass segment, has a length along the longitudinal direction that is shorter than the elongate structural reinforcement section such as to allow welding of an end region of the at least one elongate structural reinforcement section without thereby damaging the at least one glass segment.

The at least one structural reinforcement section 191, e.g. each structural reinforcement section, may extend for a distance d beyond the at least one glass segment, e.g. beyond each of the at least one glass segment, in at least one sense of the longitudinal direction x. For example, as shown in FIG. 7, the structural reinforcement section 191 may extend for a distance d beyond the glass segment at one end of the glass beam element 190, but not necessarily at the other end of the glass beam element. Nevertheless, advantageous embodiments of the present invention may relate to glass beam elements in which the at least one structural reinforcement section, e.g. each structural reinforcement section, may extend for a distance d beyond the at least one glass segment, e.g. beyond each of the at least one glass segment, in both senses of the longitudinal direction x.

This distance d may be at least, e.g. larger than or equal to, 4 times a largest diameter of a cross section of the structural reinforcement section perpendicular to the longitudinal direction.

This distance d may be at least, e.g. larger than or equal to, 8 times a largest diameter of a cross section of the structural reinforcement section perpendicular to the longitudinal direction.

Figure 23:
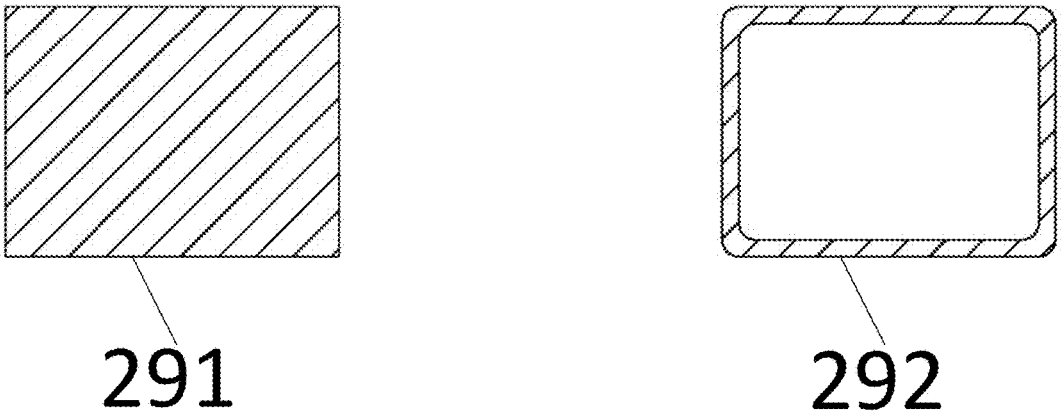
FIG. 23 shows exemplary cross sections of structural reinforcement sections in accordance with embodiments of the present invention.

Referring to FIG. 23, the cross section of the structural reinforcement section 191, e.g. of each structural reinforcement section, may have a solid rectangular shape 291 or a hollow rectangular shape 292. For example, the rectangular shape may be a square shape. The distance d may be at least 10 times a length of an edge of this rectangular shape, e.g. of any edge such as the shortest edge or preferably the longest edge, e.g. the length of an edge of a square profile. Preferably, the distance d may be at least 15 times the length of such edge.

For example, the structural reinforcement section 191 may comprise a steel alloy having a rectangular solid section or a rectangular hollow profile section.

The glass segment is bonded to the at least one elongate structural reinforcement section 191, for example in a region of the glass segment, e.g. in a tensile zone or a pressure zone of the glass segment, that may comprise at least part of an edge of the glass segment, in which this glass segment has a rectangular planar shape and said edge corresponds to a long edge of the rectangular planar shape.

The at least one elongate structural reinforcement section 191 may comprise, e.g. consist of, two parallel elongate structural reinforcement sections extending along the longitudinal direction x. The at least one glass segment 192 may be bonded along both long edges of the rectangular planar shape to respectively the two elongate structural reinforcement sections. Each elongate structural reinforcement section 191 may comprise the weldable material. The at least one glass segment 192 may have a length along the longitudinal direction x that is shorter than both elongate structural reinforcement sections 191 such as to allow welding of end regions of both elongate structural reinforcement sections without thereby damaging the at least one glass segment.

The at least one glass segment 192 may comprise at least one internal glass pane 193 and two external glass panes 194. For example, the at least one internal glass pane and/or the external glass panes may comprise a glass laminate. The at least one internal glass pane 193 may be provided in between the two parallel elongate structural reinforcement sections and in between said two external glass panes, said two external glass panes furthermore extending over the two elongate structural reinforcement sections such as to position the two elongate structural reinforcement sections in between the two external glass panes.

Furthermore, the at least one internal glass pane 193 may be longer in the longitudinal direction x than each of the two external glass panes 194.

For example, the distance d may correspond to a distance that each structural reinforcement section 191 extends beyond the at least one internal glass pane 193, e.g. at one end or at both ends of the beam element 190, in the longitudinal direction x. Furthermore, each structural reinforcement section 191 may extend beyond each external glass pane 194 in the longitudinal direction x, at one or both ends of the beam element, over a second distance d', in which this second distance d' is larger than the first distance d. For example, the second distance d' may be sufficiently larger than the distance d, such as to allow to adhesively bond another glass pane onto the exposed part of the at least one internal glass pane 193 with sufficient overlap to provide a good connection.

For example, the glass beam element 190 in accordance with embodiments of the present invention may comprise a beam laminate which may be produced in a glass processing factory with suitable lamination facilities, e.g. may relate to a hybrid beam laminate composed of one or more glass species, e.g. typically configured as a laminate stack of glass panes of same or differing glass compositions, and one, preferably two, or even more, structural reinforcement sections, e.g. made of stainless steel. In such hybrid beam laminate, the outermost glass panes of the laminate stack of glass panes, e.g. the external glass panes, may be advantageously shorter than the at least one internal glass pane. The reinforcement sections are furthermore longer than the at least one internal glass pane(s), as well as being longer than the external glass panes.

The prefabricated reinforced glass beam elements may, according to particular embodiments, comprise internal glass panes, external glass panes and reinforcement. The length of each may be different and dependent on certain design and practical factors.

For example, the length of the reinforcement sections 191 may be dependent on the intended application of the glass beam element. For example, the length of the reinforcement sections may be chosen as a centre-to-centre distance between successive supports.

The length of the external glass panes 194 may also depend on the intended application of the glass beam system. For example, the length of the external glass panes 194 may be chosen so that its ends are located close to the inflection points of the bending moment line, i.e. the points of zero moment, for the specific loading case. This may be calculated for the quasi-static load combination in ultimate limit state design. However, this does not necessarily imply that the glass beam elements are necessarily tailored to a design that is optimized for one specific application or construction. For example, a plurality of standard measures can be produced, from which an appropriate, e.g. a sufficiently close to optimal, model can be chosen.

The length of the at least one internal glass pane may, for example, be selected from a range, depending on the application. The maximum length may be governed by the heat-affected zone (HAZ) that is created during welding of the structural reinforcement section. The welding process may generate locally extreme temperatures, which would make the glass break due to thermal stresses as a result of temperature differences. An experimental assessment of the HAZ is provided further hereinbelow as an example. The minimum length may be governed by the effects of stress transfer between the glass panes over the glass-to-glass contact areas as a result of glass pane segmentation. An assessment of the minimum length is also presented in an example further hereinbelow.

Figure 29:
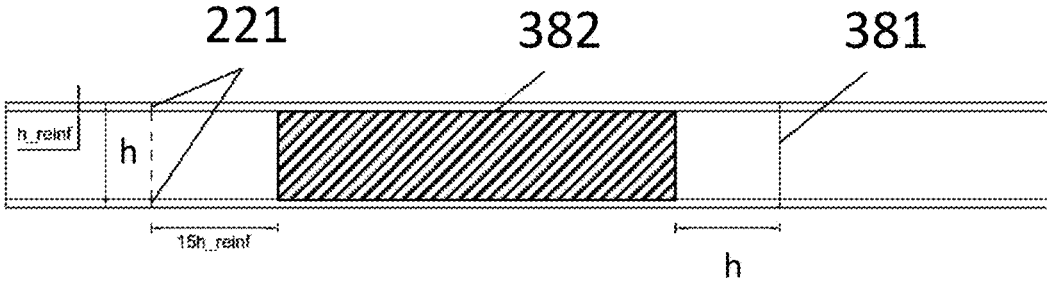
FIG. 29 illustrates an exemplary free range in which the location of a central glass pane seam might be freely chosen, in an example relating to embodiments of the present invention.

Respecting practical limits, the location of the central glass pane seam might be freely chosen, as illustrated by FIG. 29. The location of the seam may be subject to the design of the beam system, e.g. chosen specifically for each practical application. However, it may be considered good design when the at least one internal glass pane seam is chosen as close as possible to the seams 381 of the external glass panes. This is beneficial for the aesthetics of the beam system, but can also advantageously lead to a more efficient design of the beam section. Thus, an available zone 382 for accommodating the internal glass pane seam may be defined, when taking the considerations presented hereinbelow into account.

For example, when the glass beam element is intended to be used as an internal member of a load-bearing structure, e.g. in a glass beam element that may typically have protruding structural reinforcement sections at both ends in the longitudinal direction x, e.g. a glass beam element intended to be connected at both beam ends to other such beams, a maximum length of the at least one internal glass pane may be about equal to, e.g. may be equal to, the length of the structural reinforcement section minus two times fifteen times the height of the structural reinforcement section. In other words, a minimum of the distance d, as illustrated in FIG. 7, may be at least 4, e.g. at least 8, e.g. at least 10, e.g. preferably at least 15 times the height of the cross-sectional profile of the structural reinforcement section, and the at least one internal glass pane may be separated from the end of the structural reinforcement section at both ends by this distance d. A possible minimal length of the at least one internal glass pane may be the length of the external glass panes plus two times the height of the beam section. In other words, the second distance d' may be at least the height of the beam section of the glass beam element to be connected. For example, this height of the beam section may refer to a height of the glass beam element measured in a direction perpendicular to the longitudinal direction and parallel to a major plane of the glass beam element, e.g. a major plane corresponding to the orientation of the glass panes.

For example, when the glass beam element is intended to be used as an external member of a load-bearing structure, e.g. in a glass beam element that may typically have protruding structural reinforcement sections at only one end in the longitudinal direction x, e.g. a glass beam element intended to be connected at only one end to another such beam, a maximum length of the at least one internal glass pane may be about equal to, e.g. may be equal to, the length of the structural reinforcement section minus fifteen times the height of the structural reinforcement section. In other words, a minimum of the distance d, as illustrated in FIG. 7, may be at least 4, e.g. at least 8, e.g. at least 10, e.g. at least 15 times the height h_reinf of the cross-sectional profile of the structural reinforcement section, and the at least one internal glass pane may be separated from the end of the structural reinforcement section at only one end by this distance d. A possible minimal length of the at least one internal glass pane may be the length of the external glass panes plus the height h of the beam section. In other words, the second distance d' may be at least the height h of the beam section of the glass beam element to be connected. For example, this height of the beam section may refer to a height of the glass beam element measured in a direction perpendicular to the longitudinal direction and parallel to a major plane of the glass beam element, e.g. a major plane corresponding to the orientation of the glass panes.

In a second aspect, the present invention relates to a method for constructing a loadbearing structure. The method comprises obtaining a first and a second glass beam element in accordance with embodiments of the present invention. The method comprises placing the end region of the at least one elongate structural reinforcement section of the first glass beam element such as to abut the end region of the at least one elongate structural reinforcement section of the second glass beam element. The method also comprises welding the end region of the at least one elongate structural reinforcement section of the first glass beam element to the end region of the at least one elongate structural reinforcement section of the second glass element such as to obtain at least one joined elongate structural reinforcement section. The method further comprises bonding at least one connection glass segment to the at least one joined elongate structural reinforcement section, e.g. in a tensile zone and/or a pressure zone of the connection glass segment, such as to form a substantially continuous glass surface (e.g. continuous insofar some spacing in between is allowed for preventing direct glass-to-glass contact as discussed further hereinbelow) formed by the at least one glass segment of the first glass beam element, the at least one connection glass segment and the at least one glass segment of the second glass beam element.

Referring to FIG. 7, steps of an exemplary method in accordance with embodiments of the present invention, will be explained.

This method for constructing a loadbearing structure comprises obtaining a first and a second glass beam element 190, as shown in FIG. 7, in which each glass beam element 190 is a glass beam element in accordance with the first aspect of the present invention as described hereinabove. For example, the glass beam elements may comprise two prefabricated reinforced glass beams.

Figure 9:
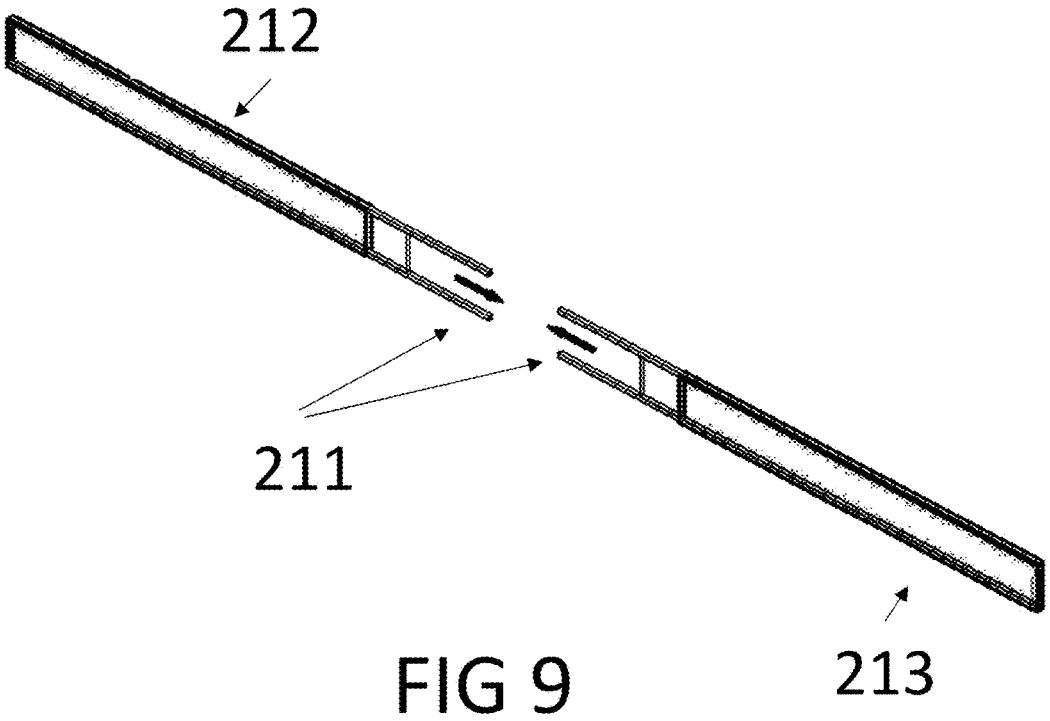
FIG. 9 illustrates a step of placing end regions in contact in a method in accordance with embodiments of the present invention.

The method comprises placing the end region of the at least one elongate structural reinforcement section of the first glass beam element such as to abut the end region of the at least one elongate structural reinforcement section of the second glass beam element, as indicated by the translation motion 195 in FIG. 7. This step of placing the end regions 211, of respectively the first glass beam element 212 and the second glass beam element 213, in contact is furthermore illustrated in FIG. 9.

Figure 10:
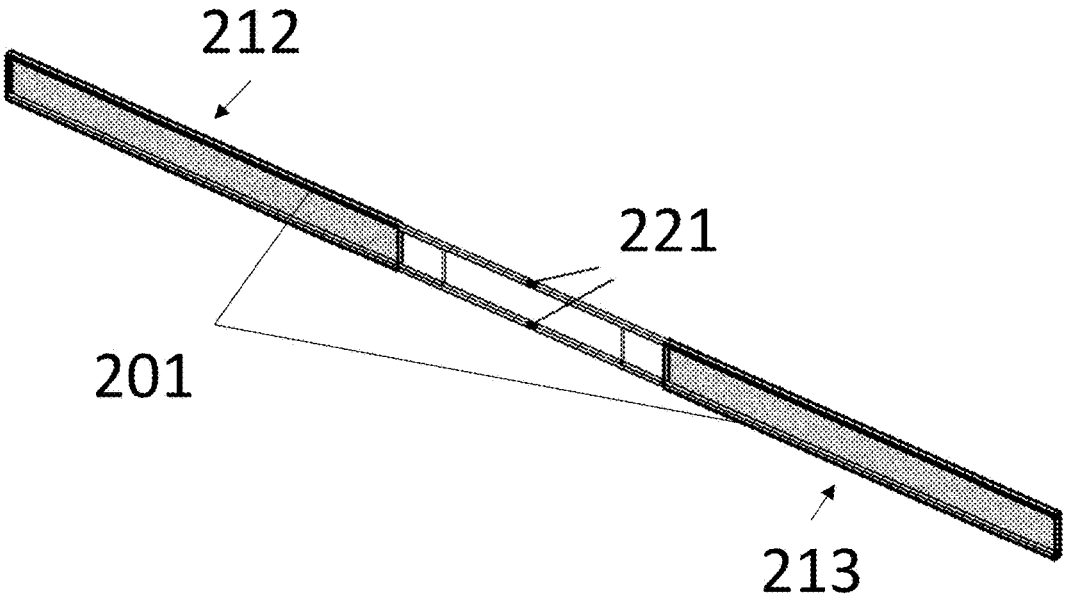
FIG. 10 illustrates a step of welding end regions of elongate structural reinforcement sections of glass beam elements in a method in accordance with embodiments of the present invention.

The method further comprises welding the end region of the at least one elongate structural reinforcement section of the first glass beam element 212 to the end region of the at least one elongate structural reinforcement section of the second glass element 213, forming welds 221, such as to obtain at least one joined elongate structural reinforcement section. This step of welding is furthermore illustrated in FIG. 10.

For example, the at least one elongate structural reinforcement section may comprise a steel alloy, e.g. stainless steel alloy, and the step of welding may comprise a TIG welding process using appropriate filler material and protection gas, as known in the art of welding steel.

This step of welding may comprise performing a circumferential weld of hollow profiles of the at least one structural reinforcement sections in the abutting end regions.

For example, the structural reinforcement section 191 may comprise a steel alloy having a rectangular hollow profile section. It is an advantage of such hollow profile reinforcement sections that no specific machining steps may be required before welding, e.g. no preparation of the weld surface may be required. The weld may be completed by performing a circumferential weld. It is an advantage of such circumferential weld of hollow profile sections that a continuous duct may be provided throughout the joined elongate structural reinforcement section, e.g. to act advantageously as a duct for a cable and/or a conduit.

A method in accordance with embodiments of the present invention may thus also comprise a step of guiding a cable and/or fluid conduit through this duct.

Figure 24:
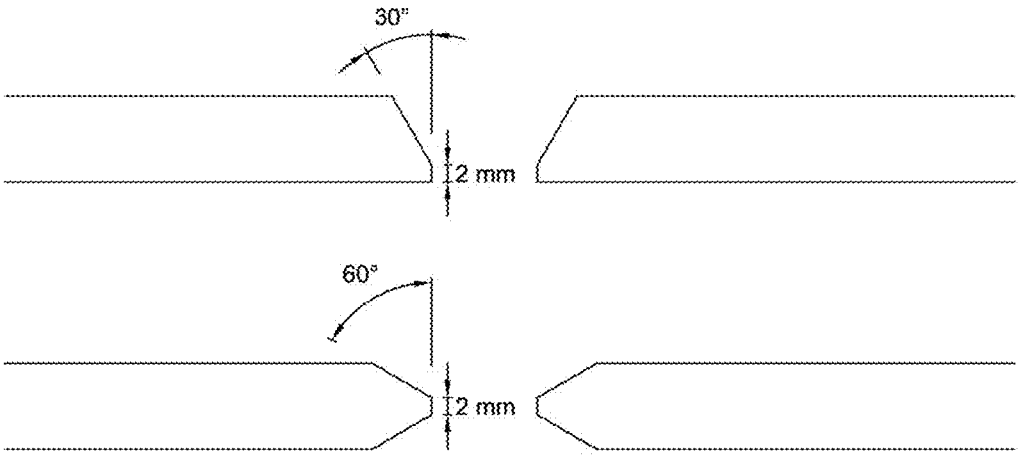
FIG. 24 shows exemplary possibilities for preparation of reinforcement ends to perform a weld, relating a method in accordance with embodiments of the present invention.

The step of welding may also comprise performing a groove weld of prepared edges of the at least one structural reinforcement sections in the abutting end regions, in which these prepared edges comprise corresponding root faces and groove faces. For example, such groove face may have a bevel angle of about 30 degrees. However, embodiments of the present invention are not limited thereto, and other types of weld may also be applied. For example, as shown in FIG. 24, a single-V weld may be applied, e.g. having a bevel angle of about 30 degrees, or a double-V weld may be applied, e.g. having a bevel angle of about 60 degrees. However, other welding techniques may also be suitable, such as a square butt joint, a single bevel joint, a double bevel joint, a single J joint, a double J joint, a single U joint or a double U joint.

For example, the structural reinforcement section 191 may comprise a steel alloy having a rectangular solid section. To perform a suitable weld, both reinforcement ends may be prepared as illustrated in FIG. 24.

The method may also comprise polishing a weld surface produced by the welding before performing the following step of bonding at least one connection glass segment to the at least one joined elongate structural reinforcement section. By polishing the welded surface thoroughly, any irregularities in the surface may be removed that might otherwise trigger glass fracture due to stress concentrations.

The method also comprises bonding at least one connection glass segment 196 to the at least one joined elongate structural reinforcement section, e.g. in a tensile zone and/or a pressure zone of the at least one connection glass segment, such as to form a substantially continuous glass surface formed by the at least one glass segment of the first glass beam element, the at least one connection glass segment 196 and the at least one glass segment of the second glass beam element.

For example, in a method in accordance with embodiments of the present invention, obtaining the first and second glass beam element may comprise obtaining such glass beam elements, e.g. in which the glass segment is bonded to the at least one reinforcement section in a region that comprises at least part of an edge of the glass segment, in which the glass segment has a rectangular planar shape and in which the edge corresponds to a long edge of the rectangular planar shape. Furthermore, the at least one elongate structural reinforcement section 191, of each glass beam element, may comprise two parallel elongate structural reinforcement sections extending along the longitudinal direction x. The at least one glass segment may furthermore be bonded along both long edges of the rectangular planar shape to respectively the two elongate structural reinforcement sections. Each elongate structural reinforcement section may comprise the weldable material, e.g. steel, e.g. stainless steel. The at least one glass segment of each glass beam element may have a length along the longitudinal direction x that is shorter than both elongate structural reinforcement sections such as to allow welding of end regions of both elongate structural reinforcement sections without thereby damaging the at least one glass segment.

In such method in accordance with embodiments of the present invention, placing the end regions of the elongate structural reinforcement sections of the first such as to abut the end regions of the elongate structural reinforcement sections of the second glass beam element may comprise placing two first end regions of respectively the two parallel elongate structural reinforcement sections of the first glass beam element such as to respectively abut two second end regions of respectively the two parallel elongate structural reinforcement sections of the second glass beam element. The two first end regions and the two second end regions may be located at a same end of respectively the first glass beam element and the second glass beam element with respect to the longitudinal direction x of the corresponding glass beam element.

Furthermore, the step of welding may comprise welding the two first end regions to respectively the two second end regions such as to obtain two joined elongate structural reinforcement sections.

For example, in a method in accordance with embodiments of the present invention, obtaining the first and second glass beam element may comprise obtaining at least one glass segment comprising at least one internal glass pane and two external glass panes, in which the at least one internal glass pane is provided in between the two parallel elongate structural reinforcement sections. The at least one internal glass pane may also be provided in between the two external glass panes. The two external glass panes may furthermore extend over the two elongate structural reinforcement sections such as to position the two elongate structural reinforcement sections in between the two external glass panes. In at least one glass segment that is obtained by such method, the at least one internal glass pane may be longer in the longitudinal direction than each of the two external glass panes.

Figure 11:
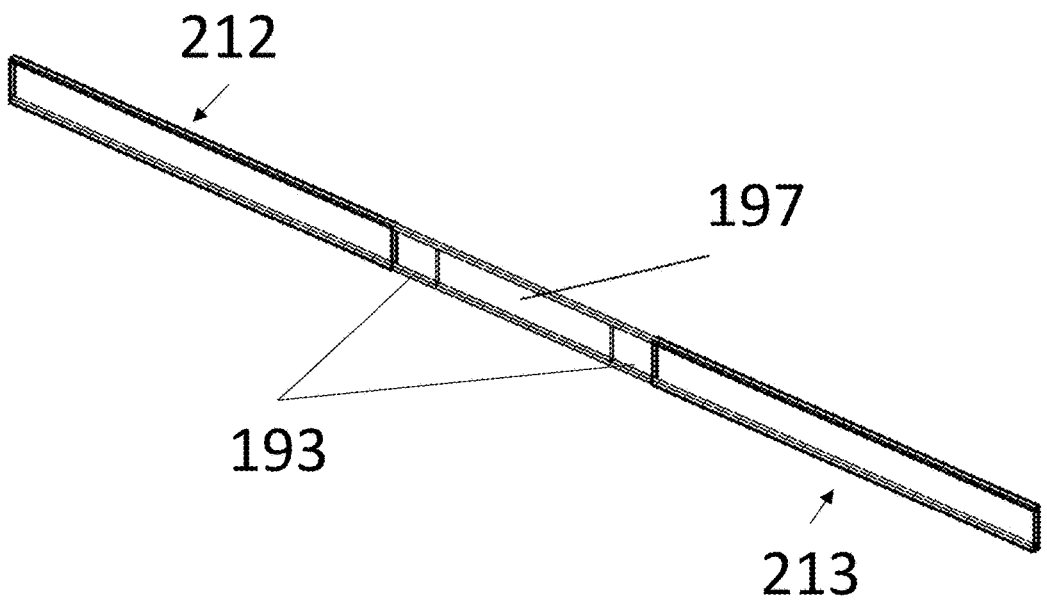
FIG. 11 illustrates a step of placing at least one internal connection glass pane while assembling glass panes in a method in accordance with embodiments of the present invention.

In a method in accordance with embodiments of the present invention, the step of bonding may comprise assembling glass panes by placing an internal connection glass pane 197 in between the at least one internal glass pane 193 of said first glass beam element 212 and the at least one internal glass pane 193 of the second glass beam element 213 and in between the two joined elongate structural reinforcement sections. This step of placing the internal connection glass plane is illustrated in FIG. 11.

Figure 12:
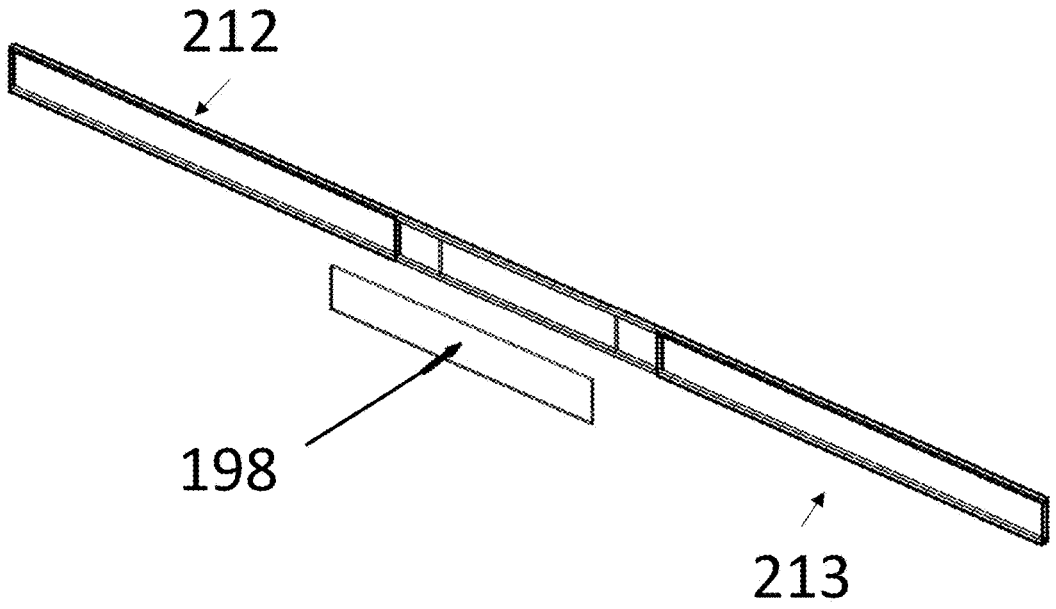
FIG. 12 illustrates a step of placing two external connection glass panes on either side of the at least one internal connection glass pane while assembling glass panes in a method in accordance with embodiments of the present invention.

This assembling may further comprise placing two external connection glass panes 198 respectively on either side of said internal connection glass pane 197. For example, the at least one connection glass segment 196 may comprise, or consists of, the internal connection glass pane 197 and the two external connection glass panes 198. The placing of the external connection glass panes on one of the sides of the internal connection glass pane is shown in FIG. 12 (only one of the two external connection glass panes is illustrated for the sake of a clear presentation).

The two external connection glass panes 198 furthermore may extend over the two joined elongate structural reinforcement sections such as to position the two joined elongate structural reinforcement sections in between the two external connection glass panes.

This step of assembling may also comprise spacing the internal connection glass pane 197 away from the at least one internal glass panes 193 of respectively the first and second glass beam element, spacing the external connection glass panes 198 away from the external glass panes 194 of respectively the first and second glass beam element, and/or (preferably and) spacing the internal connection glass pane 197 away from the external connection glass panes 198. These steps of spacing apart the various glass panes referred to may be executed such as to avoid direct glass to glass contact between these glass panes. This step of spacing may, for example, comprise placing spacers to align and space apart the glass panes.

For example, the internal connection glass pane 197 may have a length that is in the range of 1 mm to 10 mm, preferably in the range of 2 mm to 4 mm, shorter than the gap formed between the at least one internal glass panes 193 after the structural reinforcement sections have been welded together, e.g. such that dimensional tolerances are accounted for and direct glass-to-glass contact can be avoided by spacing the respective panes apart.

For example, the external connection glass panes 198 may have a length that is in the range of 1 mm to 10 mm, preferably in the range of 2 mm to 4 mm, shorter than the gap formed between the external glass panes 194 after the structural reinforcement sections have been welded together, e.g. to account for, likewise, dimensional tolerances and prevent direct glass-to-glass contact.

The internal connection glass pane may be spaced apart from each external connection glass pane at a distance that corresponds to an interlayer thickness of the reinforced glass beams. For example, the glass beam elements may comprise interlayers between the at least one internal glass pane 193 and each external glass pane 194, and each external connection glass pane may be spaced apart from the internal connection glass pane at a same distance as between the at least one internal glass pane 193 and the external glass pane 194.

Figure 13:
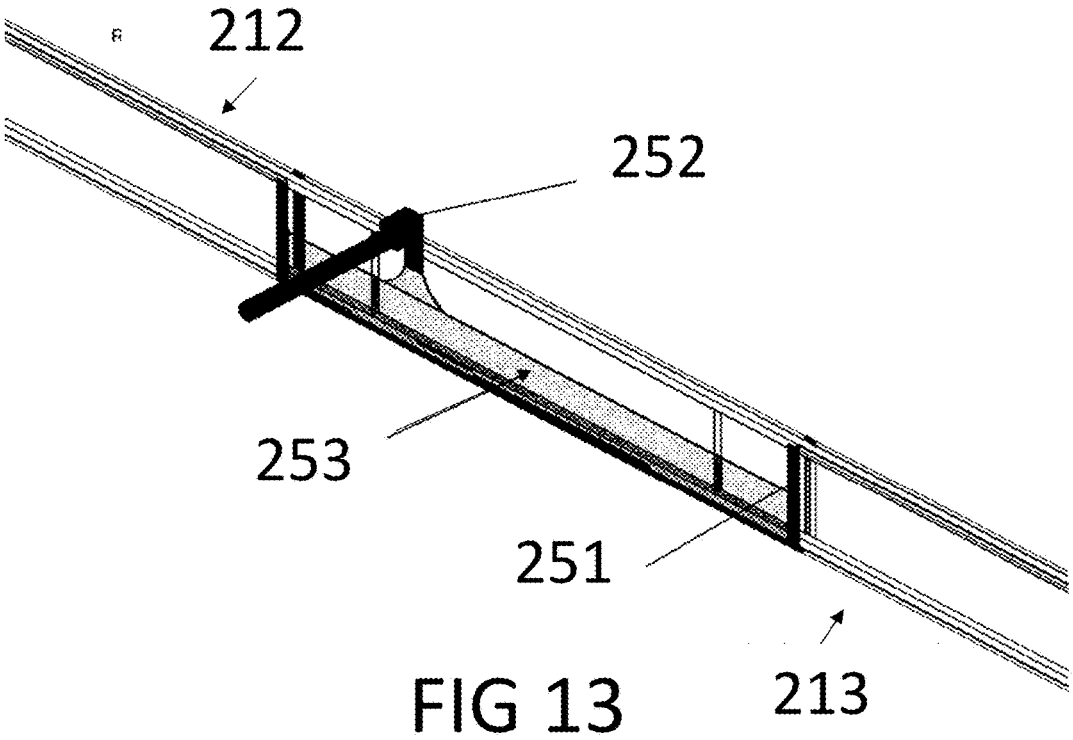
FIG. 13 illustrates a step of filling voids with a liquid adhesive in a method in accordance with embodiments of the present invention.

In a method in accordance with embodiments of the present invention, the step of bonding may also comprise filling space(s), e.g. void(s), in between the assembled glass panes with a liquid adhesive, in which the(se) space(s) are formed by the step of spacing described hereinabove. For example, such step of filling void(s) with a liquid adhesive 253, e.g. a cast resin, is shown in FIG. 13, e.g. using a filler mechanism 252. The step of filling void(s) may also comprise sealing at least a bottom section, e.g. a lower section, e.g. the entire volume forming the interconnection, such as to form a closed receptacle, in the empty space(s), for the liquid adhesive. For example, this may comprise sealing the connection area, e.g. seams formed by said spacing, with a removable sealing tape 251, such as an aluminium tape, for example with a UV transparent removable tape. Alternatively, the connection area may be sealed using a sealing paste and/or sealing adhesive, such as a silicone product.

Figure 14:
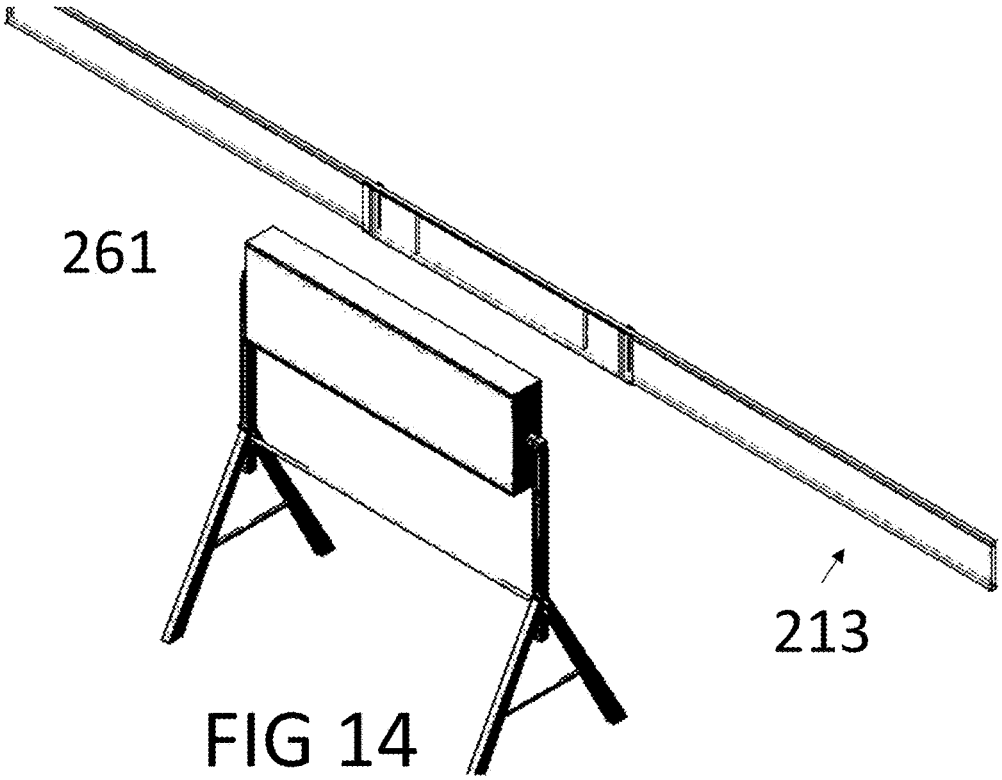
FIG. 14 illustrates a step of exposing assembled glass panes to ultraviolet radiation, in a method in accordance with embodiments of the present invention.

For example, such liquid adhesive may comprise a cast resin that cures under the influence of ultraviolet radiation. In a method in accordance with embodiments of the present invention, the step of bonding may further comprise exposing the assembled glass panes to ultraviolet radiation, e.g. UV-A radiation, in order to cure such cast resin, e.g. using a UV lighting system 261. This is illustrated in FIG. 14. For example, this step of exposing may comprise such exposure for a time period in the range of 20 to 30 minutes, embodiments not being limited thereto.

However, embodiments of the present invention are not limited to UV-curing adhesives. For example, the liquid adhesive may comprise a self-curing adhesive, e.g. which cures automatically after a sufficient curing time. For example, the liquid adhesive may comprise a heat-curing adhesive, e.g. which cures by exposure to heat.

The method may also comprise removing the removable sealing tape, e.g. in a final step.

Figure 8:
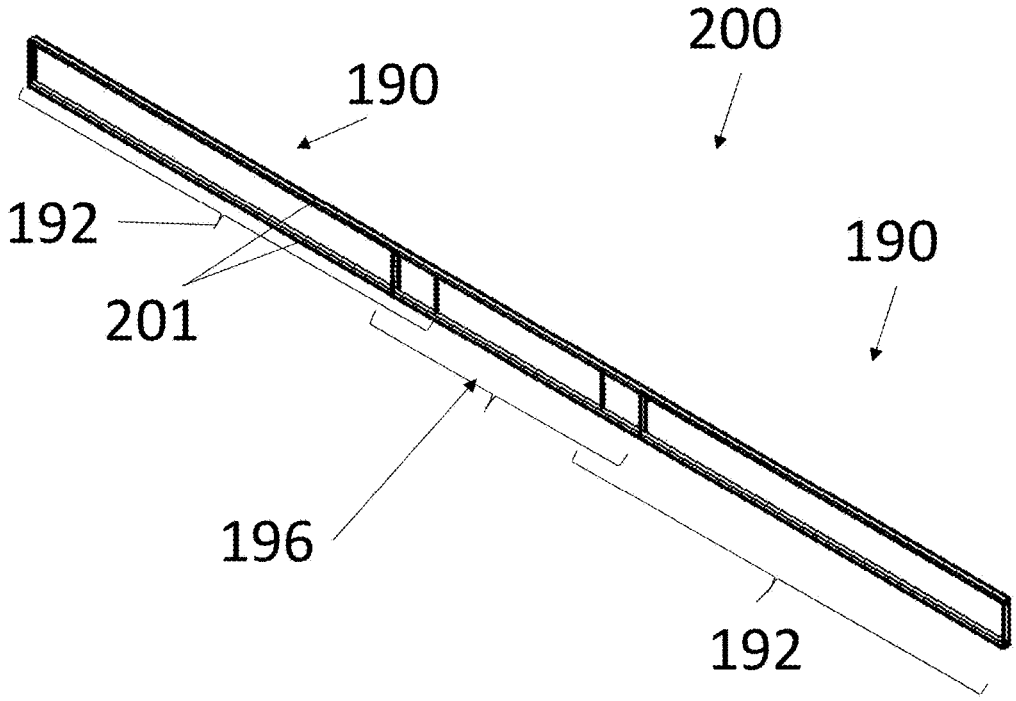
FIG. 8 illustrates a loadbearing structure in accordance with embodiments of the present invention.

In embodiments in accordance with the present invention, the step of bonding may comprise providing an adhesive film, e.g. adhesive films, in between the glass panes, e.g. in between the at least one internal connection glass pane 197 and the external connection glass panes 198 and/or in between the at least one internal glass panes 193 and the external connection glass panes 198. Such adhesive film, e.g. an adhesive foil, may comprise, for example, a silicone film, such as a transparent structural sealant adhesive (TSSA), for example such adhesive film as commercially available from Dow Corning. The adhesive film may be advantageously cured by applying heat, e.g. as opposed to bonding in an autoclave process that would require both the application of heat and of pressure. It is an advantage of such adhesive film that a good cohesion can be maintained after glass fracture. For example, the result of a method in accordance with embodiments of the present invention may be a loadbearing structure 200, as shown in FIG. 8.

Even though the description hereinabove only describes methods in which two glass beam elements are connected, it will be clear to the skilled person that such procedure can be extended by serially connecting more than such glass beam elements, e.g. each adjacent pair being connected as described hereinabove.

Figure 21:
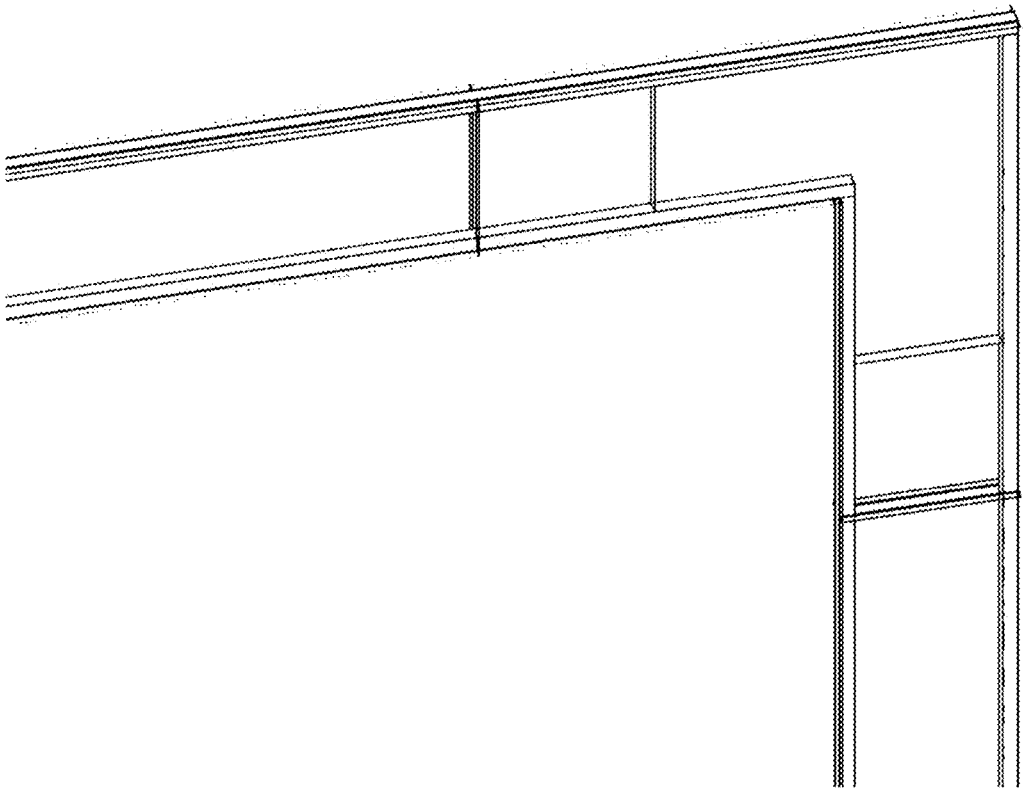
FIG. 21 illustrates the application of a method of connecting glass beam elements in accordance with embodiments of the present invention to create column-beam connections.

Furthermore, it will be clear to the skilled person that embodiments of the present invention are not limited to linear arrangements of glass beam elements. For example, as shown in FIG. 21, a method of connecting glass beam elements in accordance with embodiments of the present invention may also be applied to create column-beam connections. For example, only the at least one connection glass segment, e.g. the internal connection glass pane and the external connection glass panes, may be adapted in shape to accommodate a 90° corner, or in general, a connection of the two beam elements at any angle, if so required.

Figure 22:
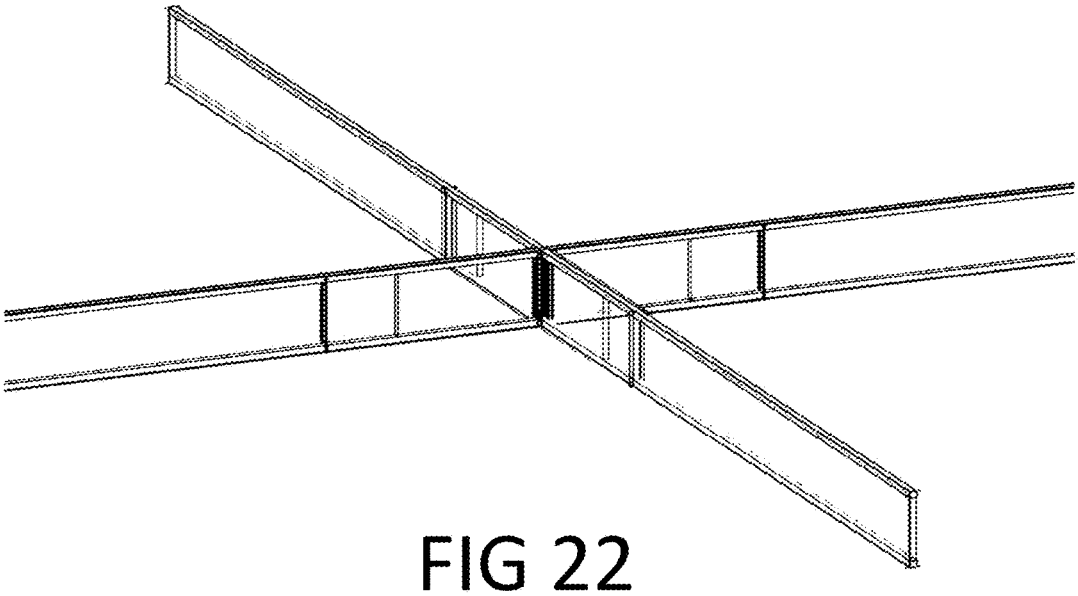
FIG. 22 illustrates more than two connected glass beam elements to create a three-dimensional structure, in accordance with embodiments of the present invention.

Furthermore, a method in accordance with embodiments of the present invention is not necessarily limited to planar connections. For example, even more than two glass beam elements may be connected to create a three-dimensional structure, e.g. to create a crossed beam system, such as illustrated in FIG. 22.

Figure 30:
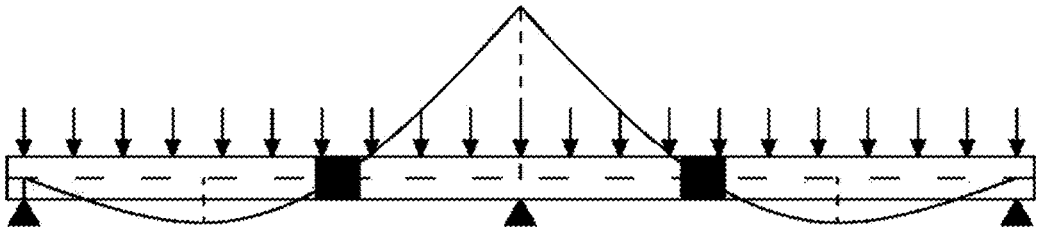
FIG. 30 illustrates a bending moment line under a continuous vertical load, in an example relating to embodiments of the present invention.
Figure 31:
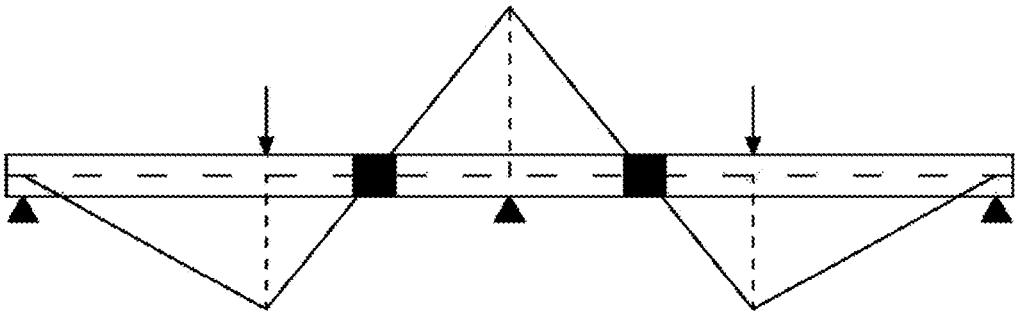
FIG. 31 illustrates a bending moment line under two point loads, in an example relating to embodiments of the present invention.

The length of the connecting glass panes, and hence the location of the glass-to-glass contact seams, may be selected according to the specific case under which the beam system is loaded. In structural design, a bending moment line may be typically calculated to calculate the beam section. In this case, the bending moment line can also be consulted to locate the minimal loaded locations of the beam system. Here, these locations may be located near the glass-to-glass contact seams. Hence, these seams may be advantageously placed at the inflection points of the bending moment line, e.g. aligned with points where the bending moment is zero in accordance with a simulation and/or structural calculation. As illustrated in FIGS. 30 and 31, the bending moment line may be dependent on the loading case. FIG. 30 illustrates a bending moment line under a continuous vertical load, and FIG. 31 illustrates a bending moment line under two point loads. The figures illustrate how the location of the seams may be determined. The black-filled zone is the zone between both seams and has a minimum length equal to the height of the beam, as discussed hereinabove.

To determine the location of the seams, a bending moment line resulting from a quasi-static load combination in ultimate limit state design may, for example, be used. Thus, a method and glass beam elements in accordance with embodiments of the present invention may enable the designer to calculate more cost-effective designs, as he does not have to strengthen the beam section at its weak spots.

In a third aspect, the present invention relates to a loadbearing structure comprising at least one connection glass segment and at least a first and a second glass beam element in accordance with embodiments of the first aspect of the present invention. The end region of the at least one elongate structural reinforcement section of the first glass beam element is welded to the end region of the at least one elongate structural reinforcement section of the second glass beam element such as to form at least one joined elongate structural reinforcement section. The at least one connection glass segment is bonded to the at least one joined elongate structural reinforcement section, e.g. in a tensile zone and/or a pressure zone of the at least one connection glass segment, such as to form a substantially continuous glass surface formed by the at least one glass segment of the first glass beam element, the at least one connection glass segment and the at least one glass segment of the second glass beam element.

Referring to FIG. 8, an exemplary loadbearing structure 200, e.g. a structure suitable for bearing a substantial load, in accordance with embodiments of the present invention, is shown. For example, a glass beam element for constructing a loadbearing structure in accordance with embodiments of the present invention may comprise a reinforced laminated glass beam for transparently connecting to other such glass beams to form a loadbearing, substantially transparent structure. For example, a loadbearing structure comprising such glass beam elements may be suitable for supporting floors and/or roofs, glass frames, e.g. large scale glass frames and/or fins for glazed facades. For example, a loadbearing structure comprising such glass beam elements may comprise a multi-span beam system.

The loadbearing structure 200 comprises at least one connection glass segment 196 and at least a first and a second glass beam element 190 in accordance with embodiments of the first aspect of the present invention.

In the loadbearing structure 200, the end region of the at least one elongate structural reinforcement section of the first glass beam element is welded to the end region of the at least one elongate structural reinforcement section of the second glass beam element such as to form at least one joined elongate structural reinforcement section 201.

In a loadbearing structure in accordance with embodiments of the present invention, the joined elongate structural reinforcement section may have a hollow cross section profile such as to form a duct in the joined elongate structural reinforcement section. In a loadbearing structure in accordance with embodiments of the present invention, a cable and/or conduit, e.g. a fluid conduit, may run through said duct.

The at least one connection glass segment 196 is bonded to the at least one joined elongate structural reinforcement section 201, e.g. in a tensile zone or a pressure zone of the connection glass segment, such as to form a substantially continuous glass surface formed by the at least one glass segment 192 of the first glass beam element, the at least one connection glass segment 196 and the at least one glass segment 192 of the second glass beam element.

In a loadbearing structure in accordance with embodiments of the present invention, the first and second glass beam elements 190 may comprise a first and a second glass beam element in which the glass segment has a rectangular planar shape and in which the glass segment is bonded to the at least one reinforcement section in a region, e.g. a tensile zone and/or pressure zone of the glass segment, that comprises at least part of an edge of the glass segment, this edge corresponding to a long edge of the rectangular planar shape. The at least one elongate structural reinforcement section of the elements 190 may further comprise two parallel elongate structural reinforcement sections extending along the longitudinal direction, wherein the at least one glass segment is bonded along both long edges of the rectangular planar shape to respectively the two elongate structural reinforcement sections. Each elongate structural reinforcement section may comprise the weldable material, e.g. steel. The at least one glass segment may have a length along the longitudinal direction that is shorter than both elongate structural reinforcement sections such as to allow welding of end regions of both elongate structural reinforcement sections without thereby damaging the at least one glass segment.

The two first end regions of respectively the two parallel elongate structural reinforcement sections of the first glass beam element may be welded to respectively two second end regions of respectively the two parallel elongate structural reinforcement sections of the second glass beam element such as to form two joined elongate structural reinforcement sections. The two first end regions and the two second end regions may be at a same end of respectively the first glass beam element and the second glass beam element with respect to the longitudinal direction of the corresponding glass beam element.

In a loadbearing structure in accordance with embodiments of the present invention, the first and second glass beam elements 190 may comprise a first and a second glass beam element in which the at least one glass segment comprises at least one internal glass pane and two external glass panes. The at least one internal glass pane may be provided in between the two parallel elongate structural reinforcement sections and in between the two external glass panes. The two external glass panes may furthermore extend over the two elongate structural reinforcement sections such as to position the two elongate structural reinforcement sections in between the two external glass panes. Furthermore, the at least one internal glass pane may be longer in the longitudinal direction than each of the two external glass panes.

The at least one connection glass segment 196 may comprise an internal connection glass pane in between two external connection glass panes. The internal connection glass pane may be located in between the at least one internal glass pane of the first glass beam element and the at least one internal glass pane of the second glass beam element.

The internal connection glass pane may be located in between the two joined elongate structural reinforcement sections, and the internal connection glass pane may be located in between the two external connection glass panes.

The two external connection glass panes may extend over the two joined elongate structural reinforcement sections such as to position the two joined elongate structural reinforcement sections in between the two external connection glass panes.

In a loadbearing structure in accordance with embodiments of the present invention, the internal connection glass pane may be separated from, and bonded to, the two external connection glass panes by layers of cured adhesive, e.g. cured resin. The cured resin may preferably have a Young's modulus in the range of 1000 MPa to 2500 MPa, e.g. in the range of 1400 MPa to 2000 MPa, e.g. about 1600 MPa, however, embodiments of the present invention are not necessarily limited to adhesives having a Young's modulus in such exemplary ranges.

For example, the layers of cured adhesive may be chemically and physically compatible with an interlayer material separating glass panes in the glass beam elements.

The cured adhesive may have a Young's modulus that is about equal to the Young's modulus of the interlayer material. For example, the cured adhesive may have a Young's modulus that is in the range of 80% to 120% of the Young's modulus of the interlayer material, for example in the range of 90% to 110% of the Young's modulus of the interlayer material.

The cured resin may further provide a connection between the internal connection glass pane and respectively the at least one internal glass pane of the first glass beam element and the at least one internal glass pane of the second glass beam element.

The cured resin may further provide a connection between each external connection glass pane and respectively a corresponding external glass pane of the first glass beam element and a corresponding external glass pane of the second glass beam element.

In a loadbearing structure in accordance with embodiments of the present invention, the at least one internal connection glass pane may be separated from, and bonded to, the two external connection glass panes by layers formed by adhesive films. In a loadbearing structure in accordance with embodiments of the present invention, the two external connection glass panes may be separated from, and bonded to, the at least one internal connection glass pane by layers formed by adhesive films. Such adhesive film, e.g. an adhesive foil, may comprise, for example, a silicone film, such as a transparent structural sealant adhesive (TSSA), for example such adhesive film as commercially available from Dow Corning.

Various examples are presented hereinbelow relating to embodiments of the present invention. Such examples are provided to help the skilled person in understanding the present invention and reducing this invention to practice. However, the examples provided hereinbelow are not to be construed as limiting the scope of the invention to only the particular examples disclosed hereinbelow, or to a specific feature(s) and/or characteristic(s) of these examples.

The first examples presented hereinbelow relate to numerical simulations of a safe and transparent connection system for connecting two reinforced laminated glass beams, e.g. to a numerical investigation of transparently connected reinforced laminated glass beams. In these examples, a series of adhesives with different stiffness are compared. It is shown that a load-carrying behaviour of the connected system is safe. Applying connecting adhesives with significantly higher stiffness than the interlayer may furthermore result in a yet better post-breakage performance, as will also be shown further hereinbelow. In these examples, a reinforcement of a glass beam is combined with a local segmentation method to realize a butt connection of the beams.

A 3D conceptual view of this exemplary connection is illustrated in FIG. 1. FIG. 1 shows a pair of glass beam elements, a method for connecting the glass beam elements and a loadbearing structure comprising the glass beam elements, having features relating to embodiments of the present invention. For example, a connection system in which structural reinforcement sections of beams are abutting to form a first type of mechanical connection between beam elements and in which glass panes are face-to-face glued for providing a second type of mechanical connection is shown.

Two laminated glass beams 11 with reduced outer glass panes, e.g. external glass panes 12 which are shorter than the (or each) internal glass pane 13, can be connected head to head by connecting their reinforcement. Then, two separate external connection glass panes 14 are glued to the central glass panel that is formed by the abutting internal glass panes 13, to complete the connection. In this way, a safe and transparent connection may be realized while requiring little on-site labour. Moreover, the position of the seams between the outer glass panels can be chosen, which is beneficial when one considers statically indeterminate systems. There, this position can be chosen to be at the points of inflection, e.g. where the bending moment is zero. The examples hereinbelow present preliminary numerical research on this prototype for several adhesives with different stiffnesses. In these examples, the glass beam system constituents were made of SentryGlas®(SG)-laminated annealed float glass (ANG) panes and stainless steel (EN1.4301).

Figure 2:
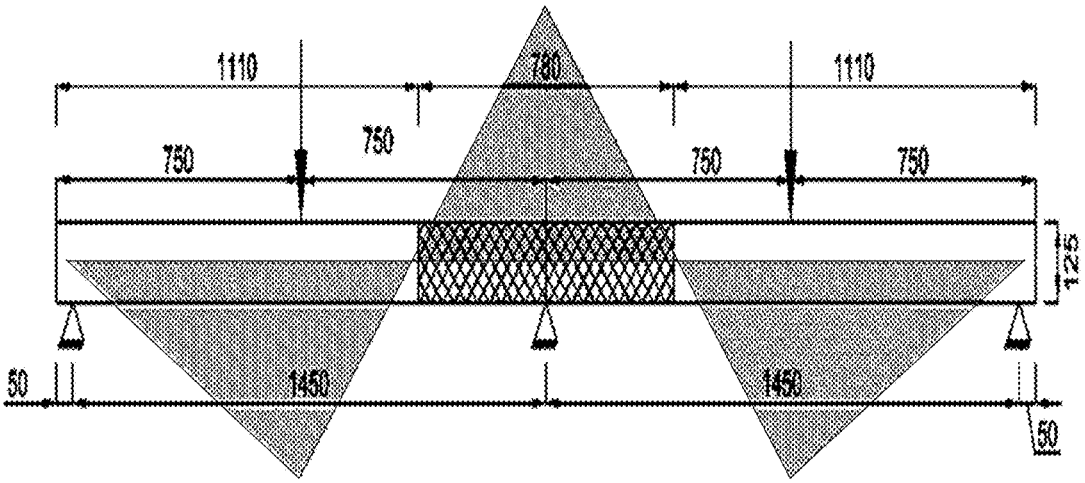
FIG. 2 shows exemplary dimensions and an exemplary geometry relating to the example for illustrating embodiments of the present invention.

FIG. 2 shows dimensions and geometry of a realistic 3D numerical model, built in Abaqus®, available from Dassault systèmes, Providence, R.I., USA, used in the examples presented hereinbelow. A test setup is illustrated with a bending moment line, and exemplary dimensions indicated in mm. A statically indeterminate five-point bending test was simulated, which may be interpreted as a part of a continued beam system. The connection was situated at the central support and the length of the connection panels was chosen so that the seams were positioned at the points of inflection. The tests were conducted, displacement-controlled and executed up to a vertical mid-span displacement of 15 mm.

Figure 3:
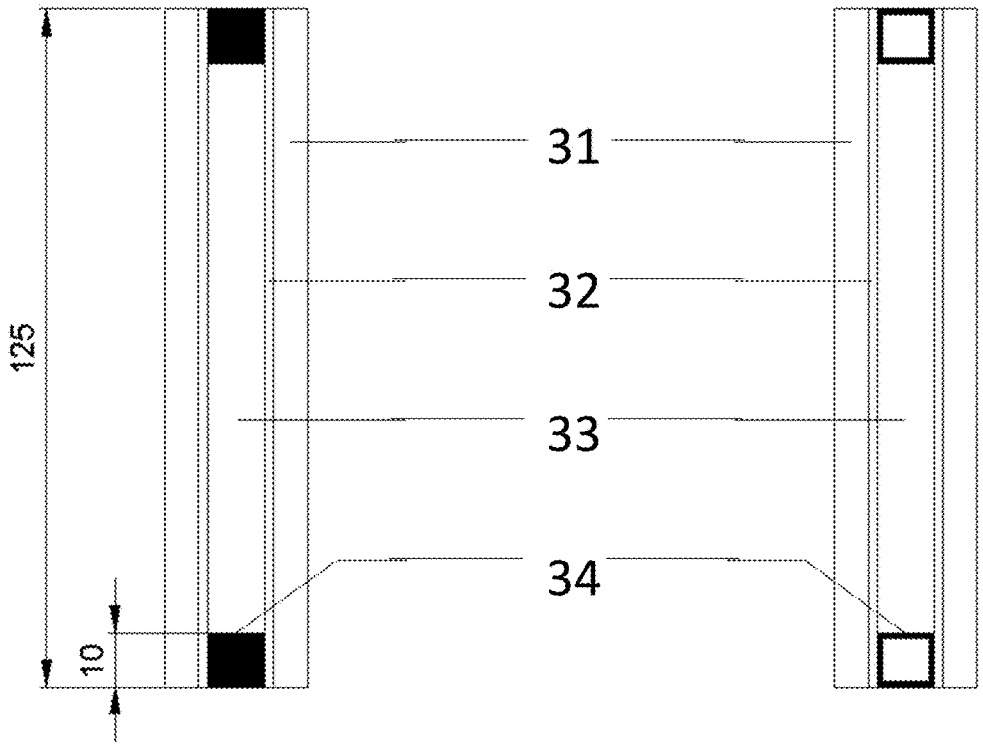
FIG. 3 shows cross sections of glass beam elements, with elongate structural reinforcement sections having respectively a solid cross section profile and a hollow cross section profile, relating to an example for illustrating embodiments of the present invention.

FIG. 3 shows cross sections, e.g. perpendicular to the longitudinal direction, of the glass beam elements, with elongate structural reinforcement sections having respectively a solid cross section profile and a hollow cross section profile. The materials and dimensions shown in FIG. 3 may correspond to a particularly advantageous selection of such materials and/or dimensions, however embodiments of the present invention are not to be construed as limited to any such material(s) and/or dimension(s). FIG. 3 shows annealed float glass external panes 31, e.g. having a thickness of 6 mm, SentryGlas® layers 32, e.g. having a thickness of 1.52 mm, annealed float glass internal panes 33, e.g. having a thickness of 10 mm, and stainless steel EN 1.4301 reinforcements 34, in respectively solid and hollow reinforcement embodiments.

The model consists of 4 different materials, namely ANG, stainless steel, SG and an UV-curing adhesive, which is in this example a member of the Delo Photobond (Glasbond) family. ANG was implemented as a linear elastic material in compression and a brittle material in tension. Stainless steel was modelled as a bilinear elastic-plastic material. Both the SG-interlayer and the adhesive were implemented as linear elastic materials. Relevant material properties are summarized in the table hereinbelow.

| Material | ρ [kg · m$^{-3}$] | E [MPa] | v [—] | $f_y$ [MPa] | $f_u$ [MPa] | $f_t$ [MPa] | $G_f^I$ [N/m] | $u_{n0}$ [m] |
|---|---|---|---|---|---|---|---|---|
| ANG | 2500 | 70000 | 0.23 | | | 45 | 3 | $1.33 \cdot 10^{-7}$* |
| Steel EN1.4301 | 7800 | 195000 | 0.27 | 550 | 850 | | | |
| SG | 1100 | 118.9** | 0.49** | | | | | |
| Delo PB GB310 | 1000 | 1600 | 0.45*** | | | | | |
| Delo PB GB345 | 1000 | 1200 | 0.45*** | | | | | |
| Delo PB GB368 | 1000 | 900 | 0.45*** | | | | | |
| Delo PB GB422 | 1030 | 50 | 0.45*** | | | | | |
| E1400 | 1000 | 1400 | 0.45*** | | | | | |
| PB400 | 1000 | 2000 | 0.45*** | | | | | |

In the table hereinabove, "*" indicates value calculated according to Abaqus ® Analysis User's Manual $u_{n0} = 2\,G_f^I/F_t$, "" indicates a value calculated for 23° C. and "*" indicates an assumed value for 23° C. according to Weller & Vogt, "Determination of Material Properties for Light-Curing Acrylates," in Glass Performance Days, 2009, pp. 363-365.

Glass cracking was implemented with the brittle cracking model for concrete in Abaqus®, using the mode I fracture energy $G_f^I$. This model was extended with brittle shear, e.g. of power law type, and an unidirectional brittle failure criterion characterized by a direct cracking failure displacement $u_{n0}$. The usage of this model involved simulations in Abaqus®/Explicit, which is a dynamic testing procedure. As quasi-static tests were performed, the kinetic energy was kept very low relative to the strain and plastic dissipation energies by increasing the step time of the simulation.

Due to symmetry, one half of the connection prototype was modelled in Abaqus®, thus providing efficiency in calculation time and memory usage. All bonding was modelled using tie constraints. Glass-to-glass contact was implemented using the hard contact model with default constraint enforcement method.

The reinforcement head-to-head connection was simplified as a continued reinforcement section. It is known in the art that a well-executed weld can be considered stronger than the section itself, therefore this simplification is a reasonable assumption for numerically studying the assembled system. Particularly, it is noted that the model used in these examples does not explicitly model the glass segments of the beams being shorter than the elongate structural reinforcement sections to allow welding. However, as mentioned hereinabove, a well-executed weld might not significantly affect the results of the exemplary simulations demonstrated hereinbelow, as either a configuration with reinforcements extending beyond the glass segment of the beam as a configuration with reinforcements being equally long as, and aligned with, the glass segment, could be equally well simulated by the approximation of a continuous reinforcement spanning multiple beams in accordance with the assumption referred to hereinabove.

Figure 6:
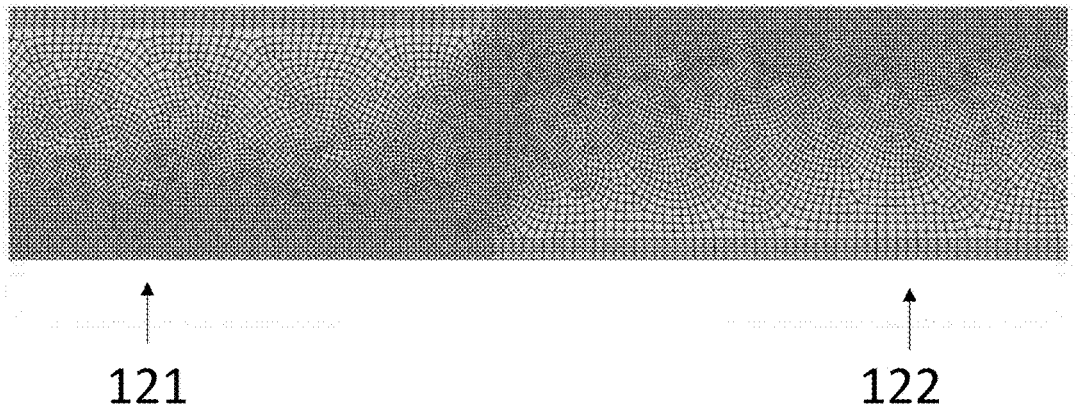
FIG. 6 illustrates a mesh pattern at a seam used in a numerical simulation relating to an example for illustrating embodiments of the present invention.

The model was meshed using the sweeping technique with advancing front algorithm. The parts of the model between both reinforcement sections were meshed without mapping. Minimum and maximum edge seeds were respectively 2 mm and 5 mm. Smallest seeds were appointed to the tensile edges of the model. five elements were chosen in the thickness direction. Eight-node linear brick elements with reduced integration and hourglass control were used. The mesh pattern at the seam is illustrated in FIG. 6, showing a detail of the mesh pattern at a seam located at the zero-moment point. FIG. 6 shows respectively a span zone mesh pattern 121 and a central support zone mesh pattern 122.

Figure 4:
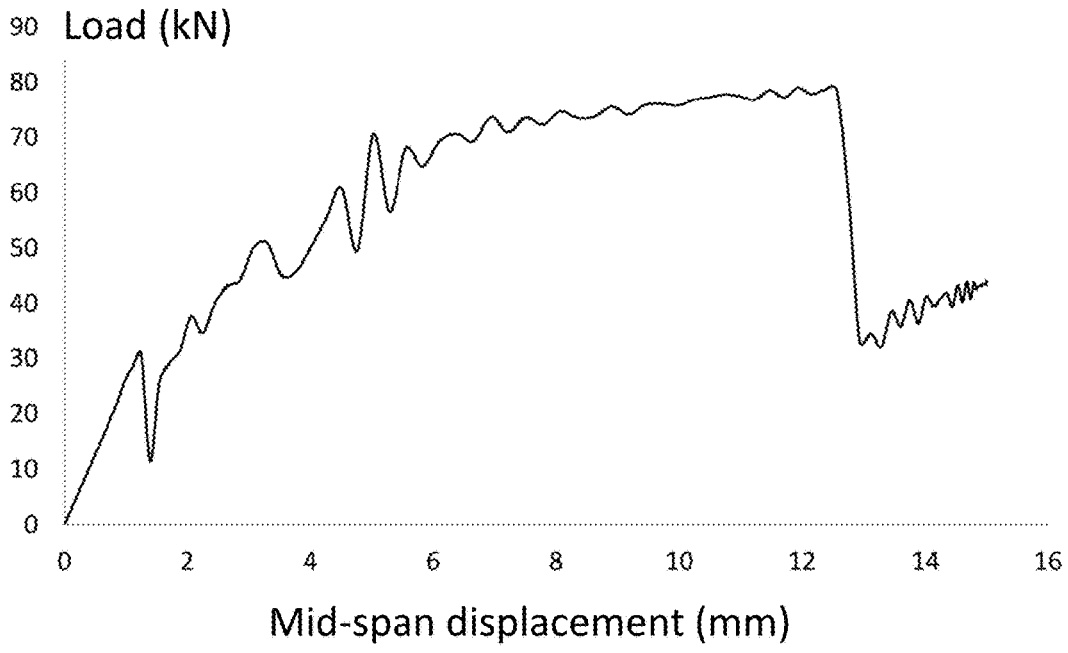
FIG. 4 illustrates typical simulated load-carrying behaviour of beams having solid steel reinforcements, relating to an example for illustrating embodiments of the present invention.

FIG. 4 shows typical load-carrying behaviour of the beams shown in FIG. 3 having solid steel reinforcements, using a Delo Photobond GB310 adhesive for adhering connection glass panes In between the beams. The figure shows, between about 1 mm and 2 mm midpoint displacement, a sudden drop of the load due to glass cracking. Between 6 mm and 8 mm midpoint displacement, the effect of central support yielding can be observed, while after mid-span yielding, a second sudden drop of load can be observed, between about 12 mm to 13 mm of mid-span displacement, due to severe glass cracking. However, in the final section of the graph, starting a little below 13 mm of midpoint displacement, a load increase is again observable towards full plastic capacity, e.g. the formation of three plastic hinges.

In following example, a model built with SG serving as connecting adhesive is shown. The results of this model were directly compared to those of a statically indeterminate five-point bending test on a continuous beam. In this way, the effect of head-to-head contact interaction between the glass panes is illustrated. in the next example, practically realistic adhesives (here of the Delo Photobond Glasbond family) are implemented in the model, to illustrate the effect of the adhesive stiffness on the overall load-carrying behaviour of the connected beam system.

This first model with SG serving as adhesive can be used to assess the effect of the glass-glass contact interactions. Therefore, this model was compared to an equivalent full-length, continuous beam model which was also tested in five-point bending. The load-displacement results are shown in the table hereinbelow.

| Beam type | Initial failure load | Mid-span deflection at initial failure load | Maximum achieved load | Mid-span deflection at maximum achieved load |
|---|---|---|---|---|
| Connected | 28.13 kN | 1.12 mm | 63.04 kN | 5.83 mm |
| Continuous | 30.25 kN | 1.12 mm | 63.59 kN | 5.02 mm |

Figure 15:
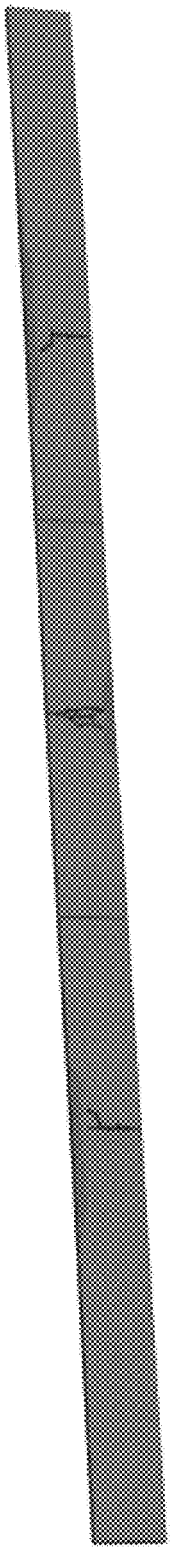
FIG. 15 illustrates an overall load-carrying behaviour of a connected beam system, in which first cracks in the span zone are formed, relating to an example for illustrating embodiments of the present invention.

First, an overview of the overall load-carrying behaviour of the connected beam system is given. After a linear elastic phase, the tensile stress of glass is reached in both the inner and outer glass pane, resulting in a first crack, located at the central support. Due to the decrease in stiffness, stress redistribution was activated and the first cracks in the span zone formed shortly afterwards, as shown in FIG. 15.

Figure 16:
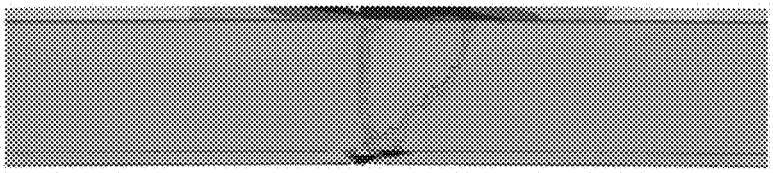
FIG. 16 shows a bottom and top reinforcement at the central support starting to yield, forming a first plastic hinge, relating to an example for illustrating embodiments of the present invention.

The beam is, however, still able to carry load as the reinforcement takes over the tensile stresses together with an intact compressive glass zone. The load continued to rise up to a load of about 65 kN. Meanwhile, both the bottom and top reinforcement located at the central support start to yield, forming a first plastic hinge, as shown in FIG. 16.

Figure 17:
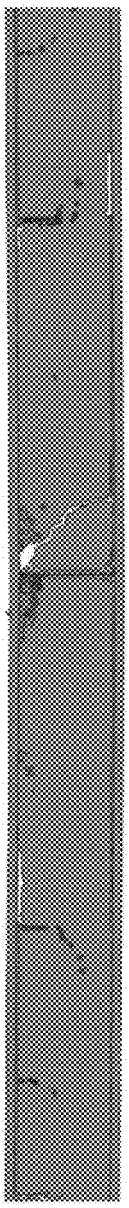
FIG. 17 shows a central support zone before load drop, relating to an example for illustrating embodiments of the present invention.
Figure 18:
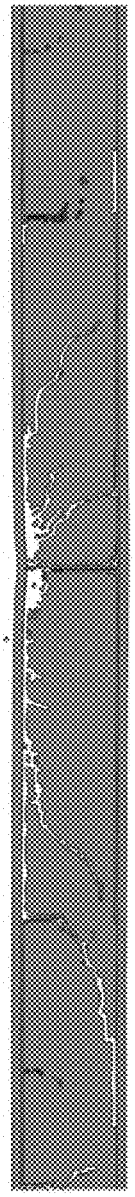
FIG. 18 shows a central support zone after load drop, relating to an example for illustrating embodiments of the present invention.

Due to an increased deformational capacity at this point, the glass is excessively loaded and several simultaneous cracks developed in the inner glass pane, giving rise to a significant load drop. However, the beam does not disintegrate and is able to hold both reinforcement sections at their place. This is illustrated in FIG. 17 and FIG. 18, which respectively show the central support zone before load drop and after load drop. However, the bottom reinforcement was pushed into the glass section at the central support.

Figure 19:
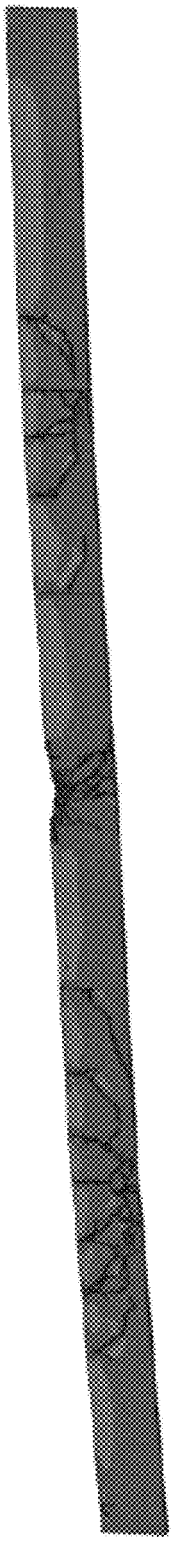
FIG. 19 show a crack pattern of the entire beam at the end of a simulation, relating to an example for illustrating embodiments of the present invention.

The load can, however, rise again due to the intact internal resisting moment constituted by both reinforcement sections. At the end, all three plastic hinges were formed and the load-displacement diagram converged horizontally, corresponding to the load reached at full plastic capacity of the system. The crack pattern of the entire beam at the end of the simulation is illustrated in FIG. 19.

When comparing load-displacement diagrams for the continuous beam model and the connected beam model the differences may appear limited, at least qualitatively. In the linear elastic zone, the full beam model illustrated slightly higher stiffness. This is directly explained by the local weakened sections of the connected system. At the central support, the connected system possesses less rotational stiffness and therefore can deform more easily, resulting in slightly higher vertical field deflections. After first breakage, the curves correspond quite well up to the significant load drop. This load drop happens at a larger vertical deflection for the connected system, which is, however, only 0.8 mm larger. This could also be addressed to the seams. However, it should be noted that at this stage, the glass already cracked at the central support and fields for both beam models, which may have reduced the relative effect of the seams. A difference is however that the cracks stopped at the glass compressive zone. Therefore, the full beam had some higher rotational stiffness resulting in smaller vertical deflections. This difference may, however, be only marginally relevant, e.g. of little significance. After the load drop, both models converged to a constant load. At this stage, both beam models cracked severely, eliminating any seam effect. The final load corresponded to full plastic capacity, which is dependent on the reinforcement sections and the distance between upper and lower reinforcement. In this case, the load value was very similar for both systems. In what follows, this connected beam model will be referred to as the reference case.

The following example presents a parameter study of the type of adhesive. Four different adhesives of the Delo Photobond Glasbond family, primarily differing in stiffness, were implemented in the basic model described in the example hereinabove and tested in five-point bending. The thickness of the adhesive, in this example, was selected as equal to the thickness of the SG-interlayer, i.e. 1.52 mm, so that the 6 mm connection glass panes were aligned with the 6 mm outer glass panes of the beams. An advised adhesive thickness, as known in the art, may be in the range of 0.1 mm to 0.2 mm, which may be significantly smaller. However, the experimental research of Weller and Vogt, in the publication previously referred to hereinabove, illustrated that the stiffness of a typical Delo Photobond adhesive can be higher for a thicker adhesive layer loaded in shear, which may be the case here.

Figure 5:
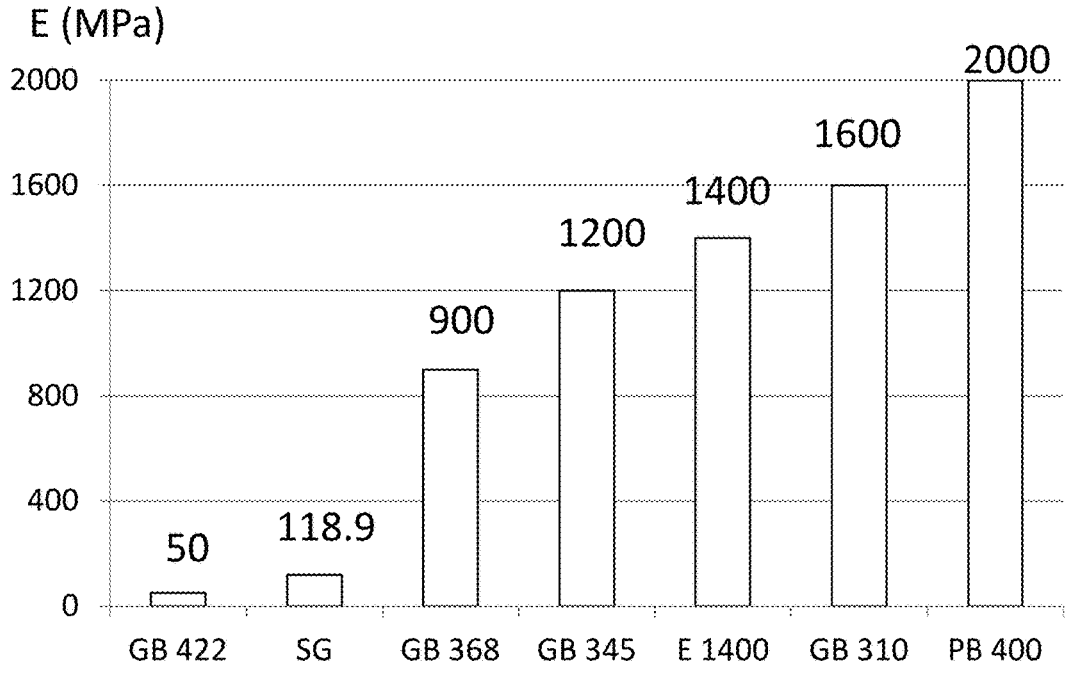
FIG. 5 shows a comparison of shear moduli of different bonding agents, relating to an example for illustrating embodiments of the present invention.

FIG. 5 shows a comparison of exemplary shear moduli of different bonding agents, for use in bonding glass panes in accordance with embodiments of the present invention, showing respectively Delo Photobond GB422, SentryGlas, Delo Photobond GB368, Delo Photobond GB345, E 1400, Delo Photobond GB310 and PB 400. Both E 1400 and PB 400 refer to hypothetical adhesives for demonstrating principles of embodiments of the present invention, embodiments of the present invention not being limited in any way to such principles and theoretical considerations.

Load-displacement characteristics of the simulated glass beam structures using respectively the four Delo Photobond Glasbond adhesives, as well as the SG interlayer reference, are presented in the table hereinbelow. It can be observed that the effect of adhesive stiffness is primarily situated in the post-breakage phase. Next to slightly different initial failure loads, the adhesive stiffness may determine when a significant load drop will happen. The more stiff the adhesive is, relative to the interlayer, the higher the initial failure load, the higher the maximum achieved load before the load drop, and the higher the vertical field displacement when the drop occurs.

| Adhesive type | Initial failure load | Mid-span deflection at initial failure load | Maximum achieved load | Mid-span deflection at maximum achieved load |
|---|---|---|---|---|
| SG | 28.13 kN | 1.12 mm | 63.04 kN | 5.83 mm |
| GB310 | 30.91 kN | 1.25 mm | 79.02 kN | 11.93 mm |
| GB345 | 31.84 kN | 1.25 mm | 69.96 kN | 6.38 mm |
| GB368 | 29.09 kN | 1.12 mm | 70.52 kN | 6.38 mm |
| GB422 | 28.81 kN | 1.12 mm | 67.07 kN | 6.38 mm |
| E1400 | 34.39 kN | 1.25 mm | 71.44 kN | 6.38 mm |
| PB400 | 31.07 kN | 1.25 mm | 77.78 kN | 9.71 mm |

Figure 20:
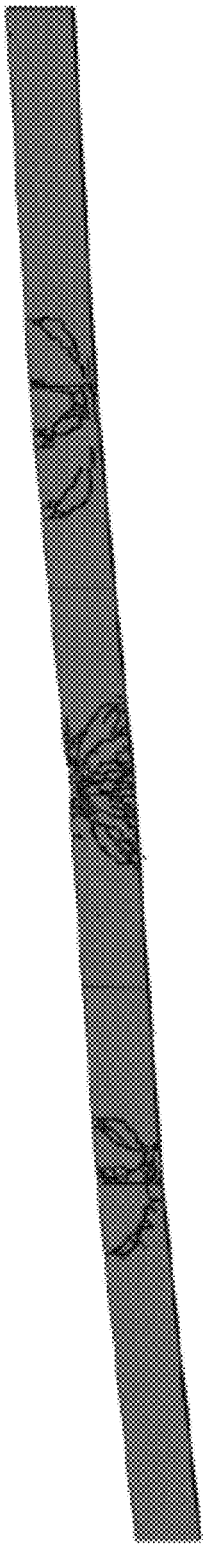
FIG. 20 show a crack pattern of another beam at the end of a simulation, relating to an example for illustrating embodiments of the present invention.

It can, for example, be seen that for a Young's modulus of E=1600 MPa, corresponding to Delo Photobond GB310 adhesive, an advantageously high ultimate load and displacement, already shown in isolation in FIG. 4, can be achieved. Due to the higher stiffness, the overall bending stiffness at the central support was higher than for the reference case. As a result, more load was needed to reach the rotation limit associated to severe glass cracking. The bending stiffness in the field is equal to the one in the reference case. Therefore, the higher load resulted in higher field displacements compared to the reference. The final crack pattern of the beam connected with Delo PB GB310 is illustrated in FIG. 20. More, but smaller, cracks were observed at the central support compared to the reference test, see FIG. 19, and less cracks were situated in the fields. The more stiff support zone attracted more stresses and hence a denser crack zone appeared.

The other adhesives only had a limited effect on the load-carrying behaviour of the system. Therefore, it may be assumed that a minimum value of Young's modulus is needed to achieve the desired effect. The GB345 load-displacement curve illustrated a smaller load drop. Due to this relatively smaller glass cracking, the distance between upper and lower reinforcement almost corresponded to the initial distance (e.g. 115 mm) at the central support, resulting in higher loads than the other models in the subsequent load-carrying behaviour. At the end of the simulation, the glass cracked further and the load-displacement curve descended to the others.

However, further increasing the adhesive's modulus of elasticity, e.g. beyond 1600 MPa, e.g. to 2000 MPa, may not necessarily result in an improved ultimate failure load and displacement, as will be described hereinbelow. In this example, two simulations were performed with fictive adhesives (E1400 and PB400) having a Young's modulus of 1400 MPa and 2000 MPa.

The more flexible adhesive having E=1400 MPa does not significantly affect the load-carrying behaviour of the system, while the more rigid adhesive having E=2000 MPa did have an effect. However, for the latter, the load drop occurred at a smaller displacement compared to the GB310-connected system. This phenomenon may be explained by observing the simulation into more detail. Here, the difference in stiffness between support and fields is so big that the support zone attracted too much stress. As a result, the glass cracks developed more rapidly and reached the compressive glass zone earlier than was the case for the GB310 adhesive. Therefore, also an upper boundary on the Young's modulus of the connecting adhesive may be assumed.

It may be concluded that an adhesive with significantly higher stiffness than the SG-interlayer might be preferable to realize the connection, as a better post-breakage behaviour could be achieved. The value of this stiffness may therefore be higher than a minimum, which could lie close to twelve times the stiffness of SG (e.g. about 1400 MPa), but may also be smaller than a maximum, e.g. to prevent the connecting glass zone from early breaking. This maximum could be about equal to 2000 MPa. Routine numerical simulations and/or experiments can be carried out by the skilled person to find an optimal adhesive stiffness. Furthermore, while these results might be reduced to practice by the skilled person, these exemplary ranges of stiffness are based on theoretical considerations and simulation models; which do not necessarily reflect an optimum in practice.

Regarding the cross-sectional profile of the reinforcements, exemplary results are illustrated by the load-displacement characteristics presented in the table hereinbelow, for respectively a solid rectangular cross section and a hollow rectangular cross section, e.g. as illustrated in FIG. 3. Both examples were simulated using the GB310 adhesive. For example, the solid cross section may correspond to an area of 100 $mm^2$, while the hollow cross section may correspond to an area of 36 $mm^2$ effectively occupied by reinforcement steel.

| Reinforcement type | Initial failure load | Mid-span deflection at initial failure load | Maximum achieved load | Mid-span deflection at maximum achieved load |
|---|---|---|---|---|
| 10 × 10 mm solid | 30.91 kN | 1.25 mm | 79.02 kN | 11.93 mm |
| 10 × 10 × 1 mm hollow | 18.28 kN | 1.12 mm | 32.02 kN | 14.24 mm |

Thus, a reduction in reinforcement material of about 64% is effected by replacing the exemplary solid reinforcement by a hollow reinforcement as illustrated.

A good load-carrying behavior can be observed for the hollow profile reinforcement. Nonetheless, a lower initial bending stiffness and initial failure load as well as a lower post-breakage strength and post-breakage stiffness are observed for the hollow profile, as compared to the solid profile. However, the sharp transition of severe glass breakage is less pronounced for the hollow profile.

An exemplary effect of adhesive thickness t, e.g. a thickness of a layer of adhesive joining two face to face glass panes, is presented in the table hereinbelow, using the adhesive GB310. As can be seen, a thicker layer of adhesive joining the glass panes may lead to a higher ultimate failure load, even though the effect may be relatively limited.

| Adhesive thickness | Initial failure load | Mid-span deflection at initial failure load | Maximum achieved load | Mid-span deflection at maximum achieved load |
|---|---|---|---|---|
| 1.52 mm | 30.91 kN | 1.25 mm | 79.02 kN | 11.93 mm |
| 1.0 mm | 29.24 kN | 1.12 mm | 76.12 kN | 11.24 mm |
| 0.5 mm | 32.16 kN | 1.25 mm | 69.15 kN | 7.22 mm |

The examples presented hereinabove showed a numerical investigation relating to properties of a connection system between two beams, as related to embodiments of the present invention. At first, the connecting adhesive was modelled as SG to assess the overall load-carrying behavior and to compare the system with a continuous full beam. It was shown that the system illustrated a good post-breakage response, with significant post-breakage strength and ductility. Furthermore, this connection model can be considered safe and practically applicable. Furthermore, no significant differences were detected between the continuous full beam and the connected beam, which means that the contact interactions between the glass panes did not have a critical effect on the load-carrying behavior. Only a slightly smaller bending stiffness and corresponding larger vertical displacements were detected for the connected system. Practically applicable adhesives were implemented to function as connecting adhesive. It is concluded that the effect of adhesive stiffness is primarily situated in the post-breakage phase. A relatively stiffer adhesive yields higher initial failure loads and shifts the significant load drop to higher load and displacement values. In full scale experiments, such load drop was furthermore not observed, which could indicate that this load drop is an artifact of the preliminary numerical model used in this example.

For connecting SG-laminated beams, the optimal adhesive stiffness might be situated between 120 MPa and 2000 MPa, embodiments of the present invention not necessarily being limited to such exemplary range.

In another example, a suitable range for the length of at least one internal glass pane of a glass beam element in accordance with embodiments of the present invention is assessed. Such maximum length may be governed by the heat-affected zone (HAZ) that is created during welding of the structural reinforcement section. The welding process may generate locally extreme temperatures, which would make the glass break due to thermal stresses as a result of temperature differences.

In a test setup, two 10 mm×105 mm×1500 mm glass panes were placed horizontally in contact in substantially perfect alignment. On top of the glass panes, two 10 mm×10 mm×500 mm steel reinforcement sections are fixed, making substantially perfect contact with the glass panes. Both contacting reinforcement ends are prepared for welding before placing them on the glass panes, see e.g. FIG. 24. Temperature is measured by means of a thermal imaging camera. During the test, both reinforcement sections are welded together while focusing the thermal imaging camera on the surrounding glass zone. Local extreme temperatures were observed and were transferred to the glass zone. Due to thermal stresses, local glass fracture and colorization was encountered.

Hence, it may be concluded that glass panes are preferably excluded from the welding zone. The at least one internal glass panes of the prefabricated reinforced glass beams in accordance with embodiments of the present invention, however, are advantageously shorter than the reinforcement sections.

Figure 25:
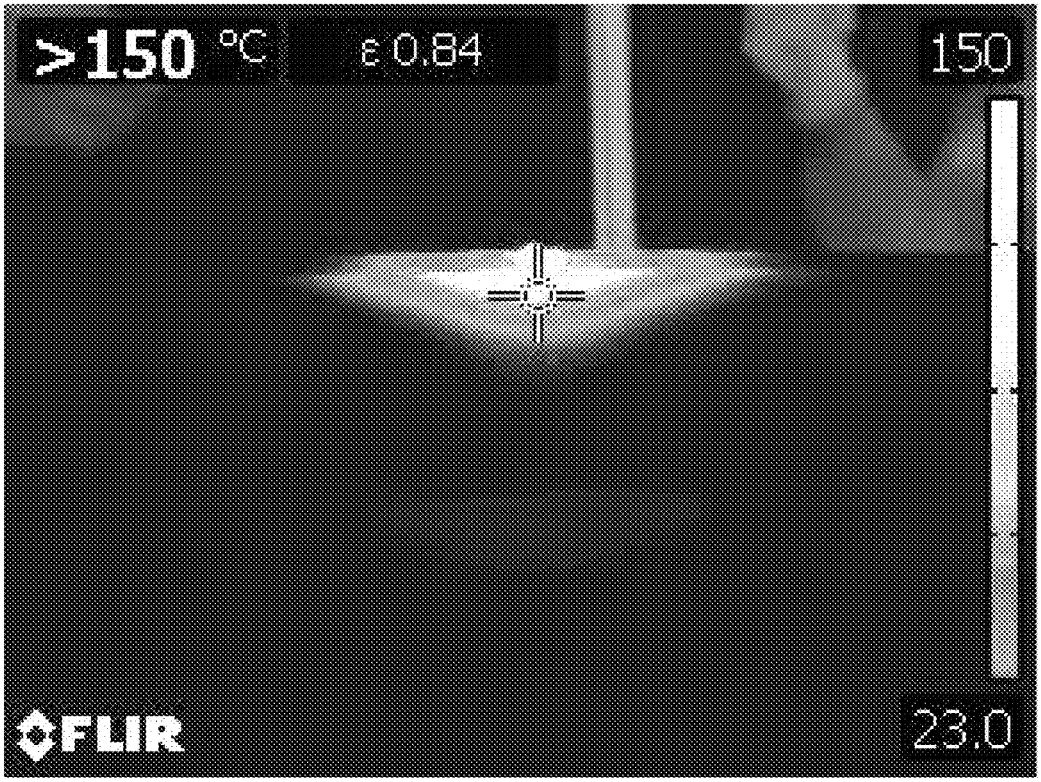
FIG. 25 shows a thermal imaging camera image illustrating a heat-affected zone of a weld, in an example relating to embodiments of the present invention.

With the thermal imaging camera, the maximum heat-affected zone of the weld could be captured. This zone is visualized in FIG. 25. When a reference temperature of 23° C. is taken, which is slightly higher than the surrounding temperature and hence the temperature of the glass pane before the test (22.6° C.), it may be concluded that the HAZ stretches out over a length of one pane height (ca. 105 mm), or 10 times the height of the reinforcement, in each glass pane.

As a result, the distance between the ends of the reinforcement and internal glass pane of the prefabricated reinforced glass beam may be preferably set to a conservative minimum of 15 times the height of the reinforcement. In this way, the glass may likely not be subjected to thermal stress effects due to the welding process.

In a further example, an assessment of a suitable minimum length of the at least one internal glass pane of a glass beam element in accordance with embodiments of the present invention is presented. This minimum length may be governed by the effects of stress transfer between the glass panes over the glass-to-glass contact areas as a result of glass pane segmentation.

Figure 26:
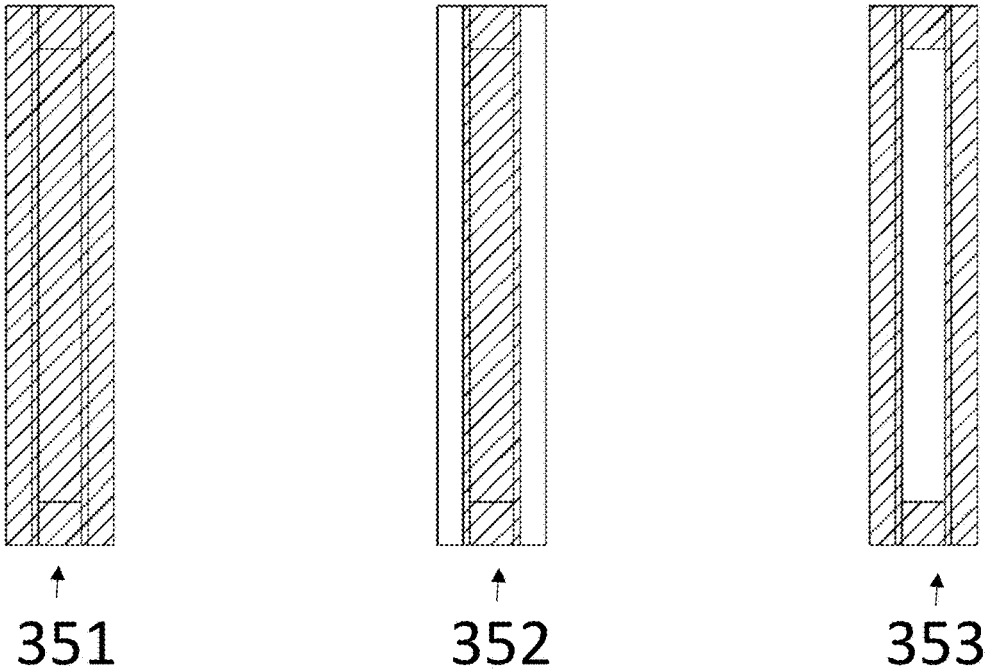
FIG. 26 shows three glass beam sections, in an example relating to embodiments of the present invention.

A segmented scheme for the external and internal glass panes is chosen to limit the local weakening of the beam section. Two 'weaker' beam sections are present in the current example, namely a beam model 352 where the external glass panes and a beam model 353 where the at least one internal glass pane is interrupted. Both sections are illustrated, next to the unweakened section 351 in FIG. 26.

Glass pane interruption may lead to stress transfer from external glass panes to internal glass panes and vice versa. As a result, stress concentrations are present in the at least one internal glass pane at section 352 and in the external glass panes at section 353.

Figure 27:
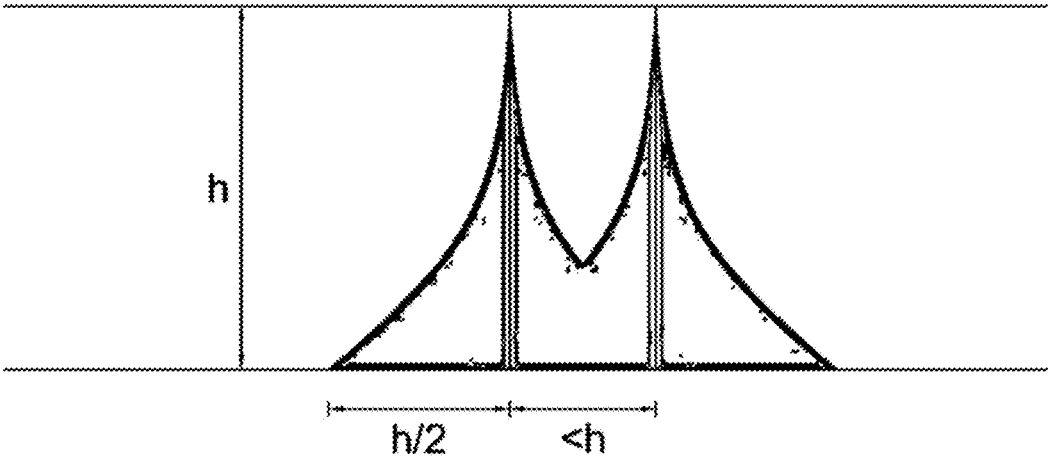
FIG. 27 shows concentration of stress transfers at small load values when an overlap distance is relatively small, in an example relating to embodiments of the present invention.

For the stress transfer to work smoothly, and thus to avoid extra stress concentrations in the glass, the beam section needs to be complete over a certain length before and after the glass pane interruption. Hence, if both sections 352 and 353 would lie too close to each other, i.e. they lie in each other's influence zone, stress transfer would be concentrated leading to stress concentrations in the glass and hence glass fracture at smaller load values, as shown in FIG. 27.

Figure 28:
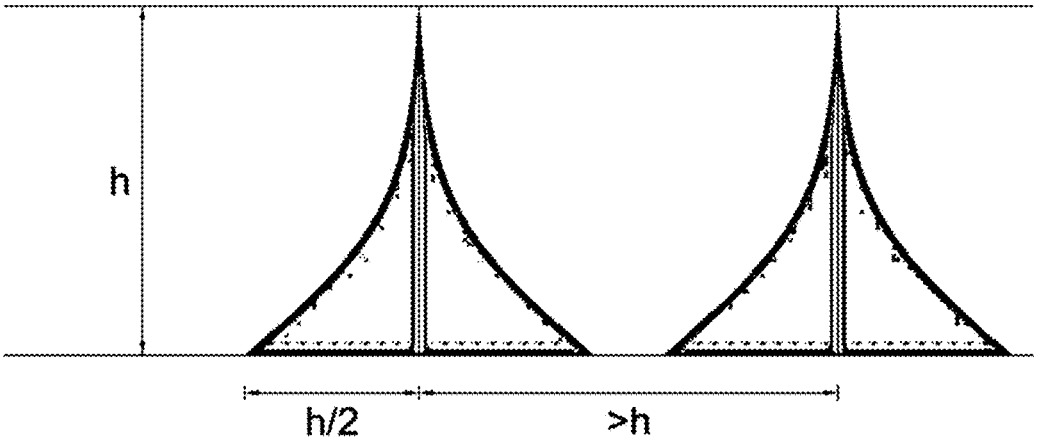
FIG. 28 shows stress transfers when an overlap distance is relatively large, in an example relating to embodiments of the present invention.

As a result, it may be concluded that a minimum distance should be preferably kept between both the sections 352 and 353. Typically, the influence zone of an interrupted section can conservatively be taken as one half of the beam height at each side of the section, e.g. one beam height in total. As a result, the distance between both sections 352 and 353 should at least be one beam height, as illustrated in FIG. 28.

In a further example illustrating embodiments of the present invention, experimental test results on connected beam specimens are presented hereinbelow. The tested specimens illustrate a safe load-carrying behavior characterised by significant post-fracture capacity.

Figure 32:
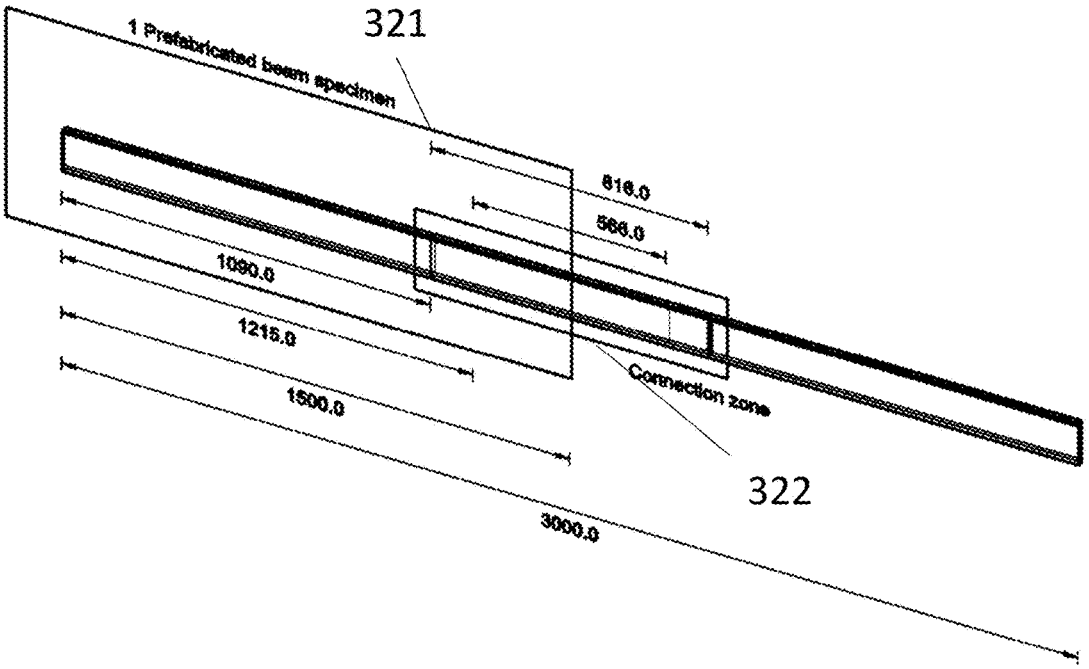
FIG. 32 shows a three-dimensional schematic view of beam specimens, in an example relating to embodiments of the present invention.
Figure 33:
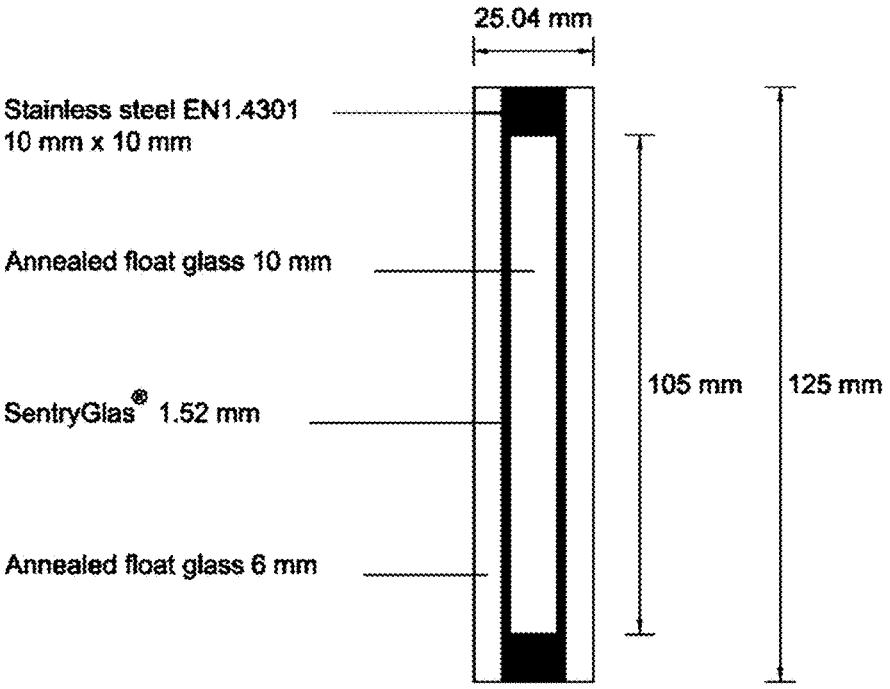
FIG. 33 shows beam specimen sections, in an example relating to embodiments of the present invention.

In FIGS. 32 and 33, an overview of the exemplary specimen build-up is given. Exemplary dimensions of various parts are provided in FIG. 32 and FIG. 33 in mm units. The two 1.5 m prefabricated beam parts, see e.g. prefabricated beam specimen 321, may consist of a triple-layered laminate of annealed float glass (ANG), using SentryGlas® (SG) interlayer sheets. The central glass pane has a reduced height to house a stainless steel reinforcement section at the top and bottom edge. The interlayer provides the bond between reinforcement and glass laminate. The longitudinal dimensions of the glass panes and reinforcement sections were determined as described hereinabove.

Two prefabricated beam parts were experimentally connected, e.g. in connection zone 322, as described hereinabove, using the cast resin Uvekol®, creating 3 m long connected beam specimens. After the beams are connected, they are stored for two weeks in a climatic chamber at 20° C. and 60% relative humidity. Two different test series, each containing three test specimens out of a total of 6, were established. An overview is given in the table hereinbelow. The varied parameter is the reinforcement percentage, where 'H' refers to a 10 mm×10 mm×1 mm hollow profile reinforcement and 'S' to a 10 mm×10 mm solid reinforcement. FIG. 33 shows the exemplary solid profile reinforcement 'S'.

| Series | Reinforcement type | Test Temperature | Number of specimens |
|---|---|---|---|
| S-23 | Solid | 23° C. | 3 |
| H-23 | Hollow | 23° C. | 3 |
| Total | | | 6 |

All exemplary (connected) beam specimens were composed of the four materials annealed float glass (ANG), SentryGlas®, Uvekol® and stainless steel. The table hereinbelow gives an overview of various relevant material properties of these materials.

| Material | float glass | SentryGlas | Uvekol S20 | SS EN1.4301 |
|---|---|---|---|---|
| Density (kg/m$^3$) | 2500 | 950 | 1001 | 7900 |
| Young's Modulus (MPa) | 70000 | 110.53 | 47 | 200000 |
| Poisson ratio | 0.20 | 0.49 | n/a | 0.29 |
| Yield Strength (MPa) | n/a | n/a | n/a | 203-210 |
| Tensile Strength (MPa) | 45 | 34.5 | 17 | 520-750 |
| Elongation at fracture(%) | n/a | 400 | 250 | 45 |
| Glass Transition Temperature (° C.) | 575 | 55 | 46 | n/a |
| Coefficient of thermal expansion ($10^{-6}$/K) | 9 | n/a | n/a | 16 |

A statically indeterminate five-point bending test setup was constructed at the Laboratory for Research on Structural Models, Ghent University. In the design phase, the aim was to make the test setup as compact and adjustable as possible, as this test setup may be required to be moveable and allow for a variety of beam heights and support conditions. Furthermore, the setup had to fit in the climatic chamber of the lab, so that a variety of temperature and humidity conditions could be applied during the tests. The tests presented here were carried out at a relative humidity of 55% and a temperature of 23° C. The test setup was placed in a 3.0 m by 3.9 m climatic chamber with a height of 2.4 m, in which temperature and humidity were continuously controlled.

The test setup consisted of a main steel frame on which vertical supports, lateral supports and an actuator are mounted. The steel frame consists of a welded horizontal base frame composed of HEA 120 grade S235 profiles on which two vertical HEA 120 profiles of the same steel grade are welded. The columns are interrupted to limit the height of the frame for transportation purposes. The columns can be reconnected with a heavy bolted connection consisting of M16 bolts grade 8.8. To increase the overall stiffness of the frame, four 70 mm×25 mm diagonal S235 steel bars connect the top of the columns (using M10 8.8 bolts) to the outer corners of the base frame (using M8 8.8 bolts), creating four large triangles.

Two outer vertical supports composed of 50 mm×50 mm×2 mm hollow S235 steel sections are mounted on the base frame using 6 M8 8.8 bolt. Small positional adjustments of these supports are enabled by applying slotted holes for the bolted connections. The beam specimens are directly supported by half-cylindrical S235 steel heads with a diameter of 60 mm, that are welded on 30 mm×50 mm×80 mm S235 steel blocks. The steel blocks transfer the reaction force to the hollow steel sections through two M10 grade 8.8 bolts. The central support is composed of a screw jack on which a 40 mm×40 mm×250 mm S235 steel section is welded. The motion of the screw jack is limited to the vertical direction by two vertical U-shaped guiding S235 steel profiles that hold the 250 mm steel section in position. A steel pin is welded on the latter to house a load cell (which has a tube-like shape). The screw jack, which is used to level the beam specimens before the start of the test, is fixed (during the test) by placing 20 mm×40 mm×300 mm S235 steel bars in the guiding profiles. All supports are equipped with half-cylindrical S235 steel heads with a diameter of 60 mm to realize simple supports.

A 100 kN single-acting actuator with a stroke of 250 mm is fixed to a HEM 100 grade S235 steel profile which is placed in between and bolted to the columns of the main steel frame with M12 8.8 bolts. The latter are endowed with a vertical array of holes so that the actuator can be shifted vertically. A loading beam (IPE 240 grade S235 steel profile) with two bolted (using M6 8.8 bolts) load punches and welded lateral supports is hinged attached to the actuator's press pod. The position of the load punches can be shifted so that a variety of load spans is possible. As the actuator is single-acting (it pushes out hydraulically and slides back to its original position by means of springs), a pulley system with S235 steel blocks was used to compensate for the loading beam's weight, hence enabling the actuator to slide back upon unloading.

The lateral supports consist of a double system. First, S235 steel U-sections are butt-welded to the bottom flange of the loading beam to laterally hold the glass beams in place by means of 10 mm×50 mm×300 mm aluminium pads. The latter can be positioned by screws to allow for varying beam thickness. Second, as the loading beam itself can rotate freely about the vertical axis, four welded triangles composed of 50 mm×50 mm×2 mm hollow steel sections of grade S235 are placed close to the loading beam and fixed to a HEA 100 S235 steel profile by means of screw clamps. The steel profile is fixed to the steel base frame using M8 8.8 bolts. In this way, the horizontal rotation of the loading beam is restrained. The position of the latter lateral supports can be varied as a horizontal array of holes is present in the base frame.

To avoid direct contact between glass and steel at the outer supports, 25 mm aluminium plates with a thickness of 2 mm were placed between the glass beam and the cylindrical steel heads. At the load introduction points and the central support, wire-cut medium-carbon steel U-shaped pieces with a width of 30 mm, equipped with a 5 mm×25 mm×30 mm rubber strip, are slided on the glass beam. The outer side of the U-shaped pieces has a cylindrical shape (with a diameter of 60 mm) and perfectly fits the support heads. To avoid influence on possible local buckling effects, the cylindrical contact surface was greased so that sliding between the load introduction point and the U-shaped element was possible. Furthermore, the overlap with the vertical glass 93 panes was limited to 25 mm, which is only one fifth of the nominal beam height.

The measurement system consists of 5 linear variable differential transformers (LVDTs) and two load cells. Three LVDTs measure the vertical displacement of the supports. The other two measure both midspan displacements of the glass beam specimen. One load cell (integrated in the pump station of the actuator) measures the total load, while the other one is placed at the central support to measure the reaction force.

Figure 34:
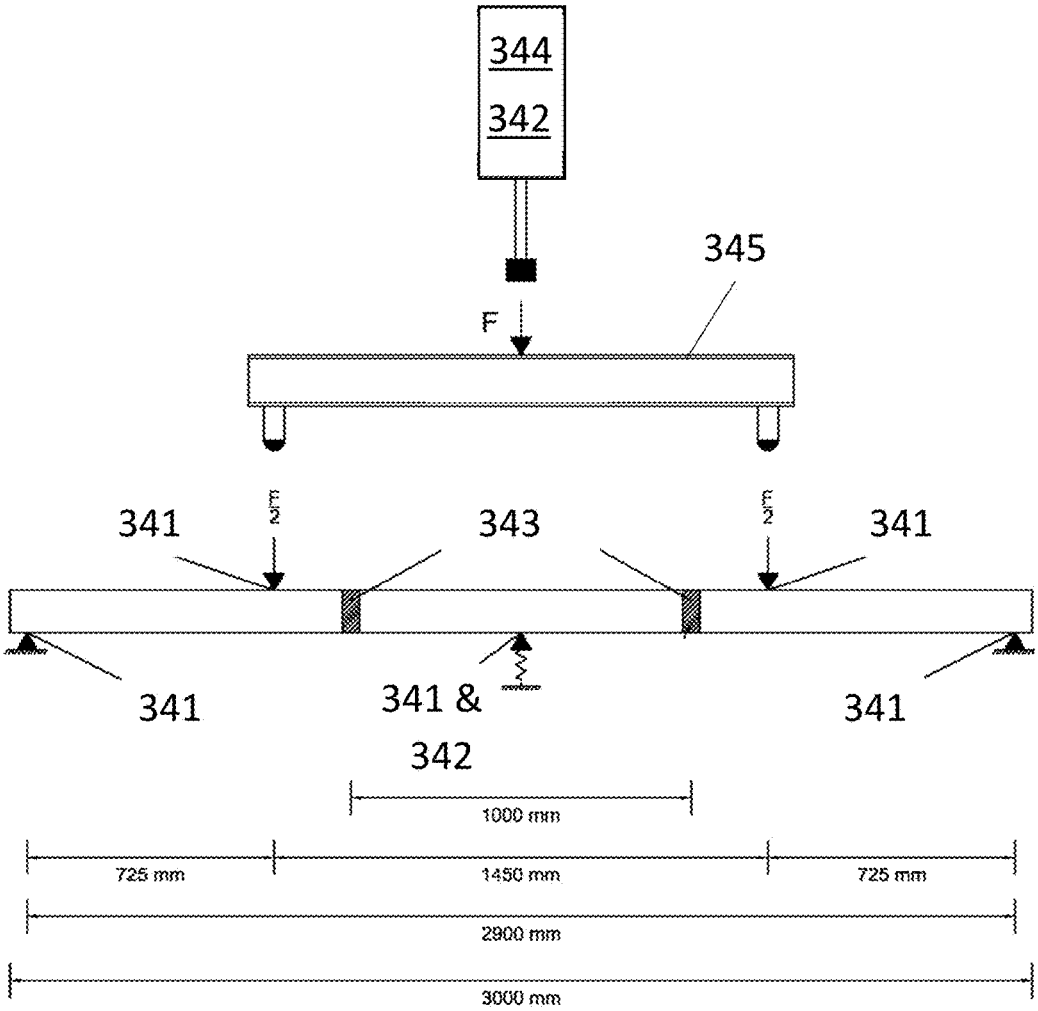
FIG. 34 shows a schematic illustration of a test setup in an example relating to embodiments of the present invention.
Figure 35:
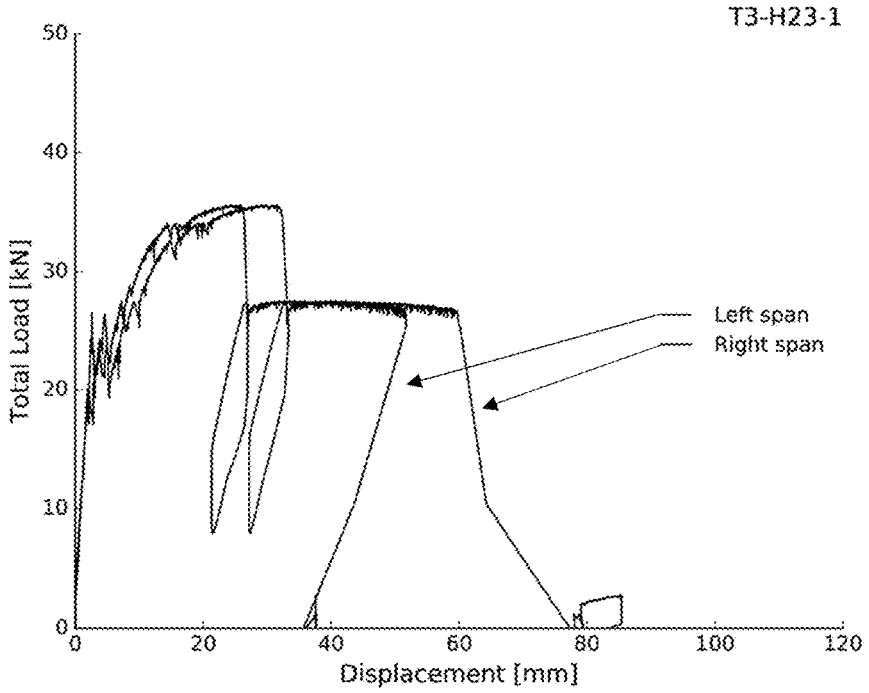
FIGS. 35 to 46 provide an overview of load-displacement (FIGS. 35 to 40) and load-moment diagrams (FIGS. 41 to 46) obtained for three solid reinforcement samples (FIGS. 38 to 40 and FIGS. 44 to 46) and three hollow reinforcement samples (FIGS. 35 to 37 and FIGS. 41 to 43), in an example experiment relating to embodiments of the present invention.
Figure 36:
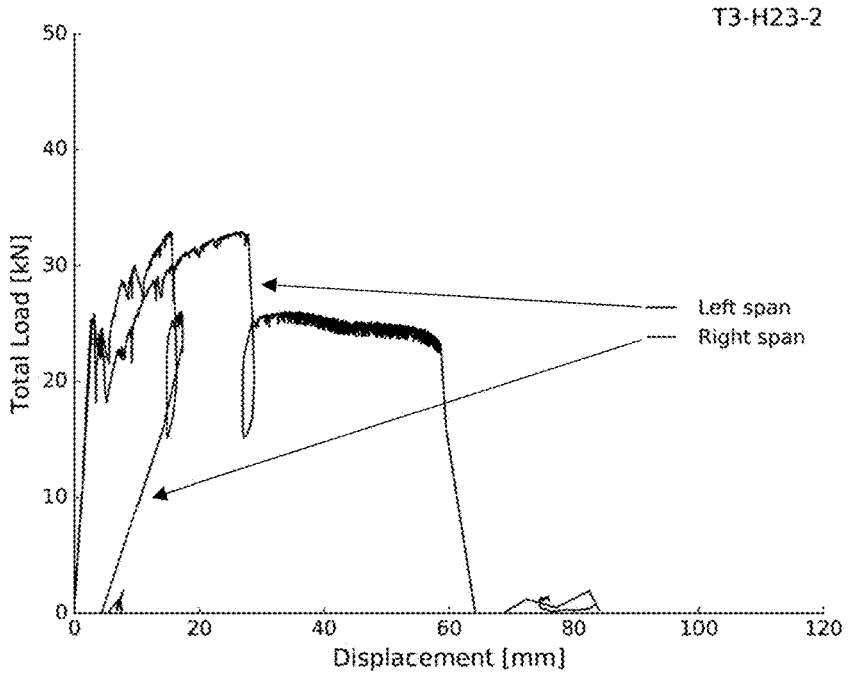
Figure 37:
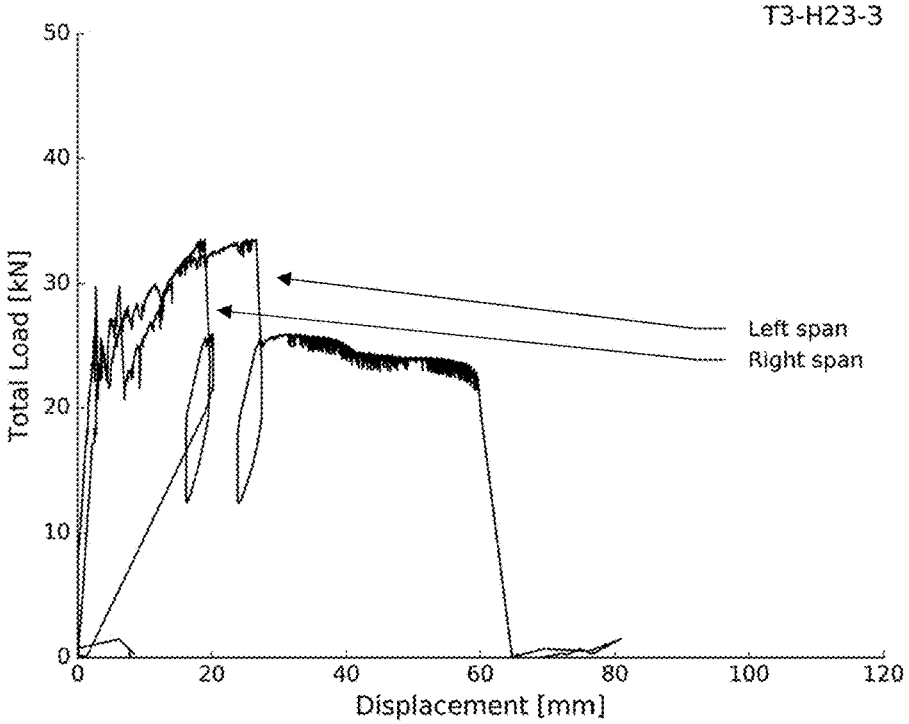
Figure 38:
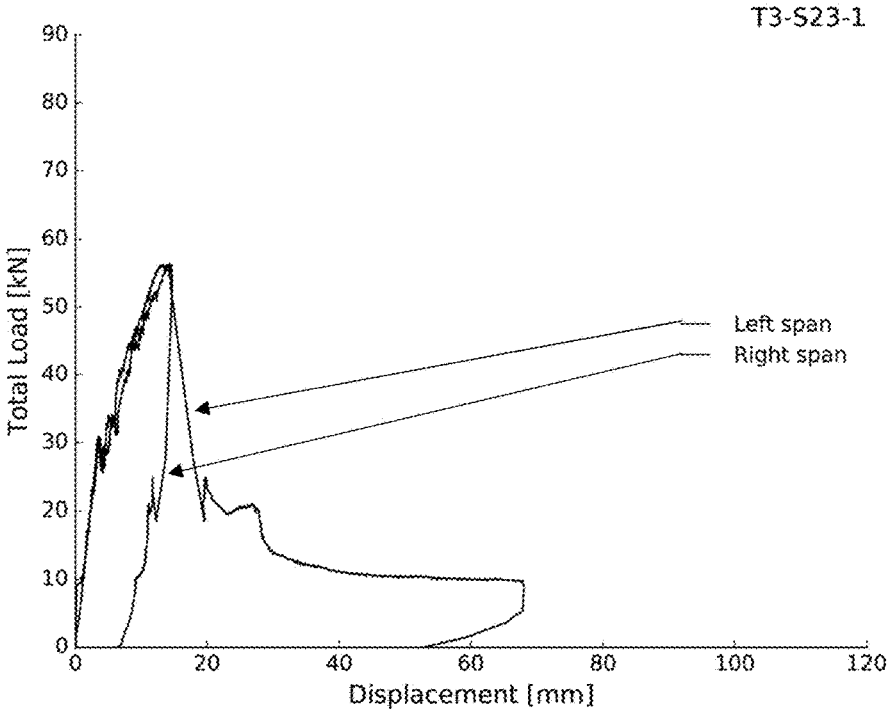
Figure 39:
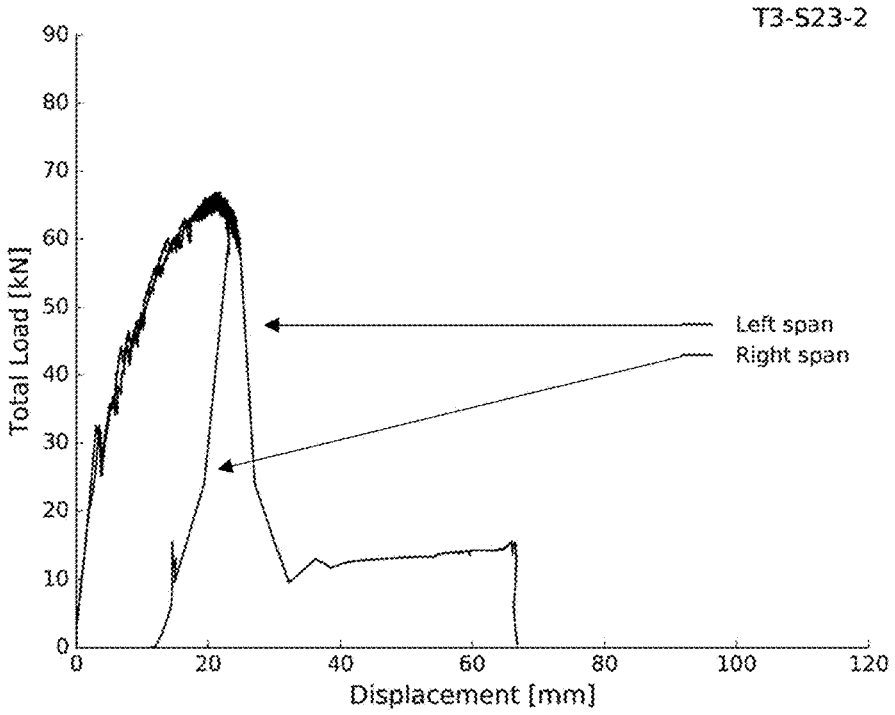
Figure 40:
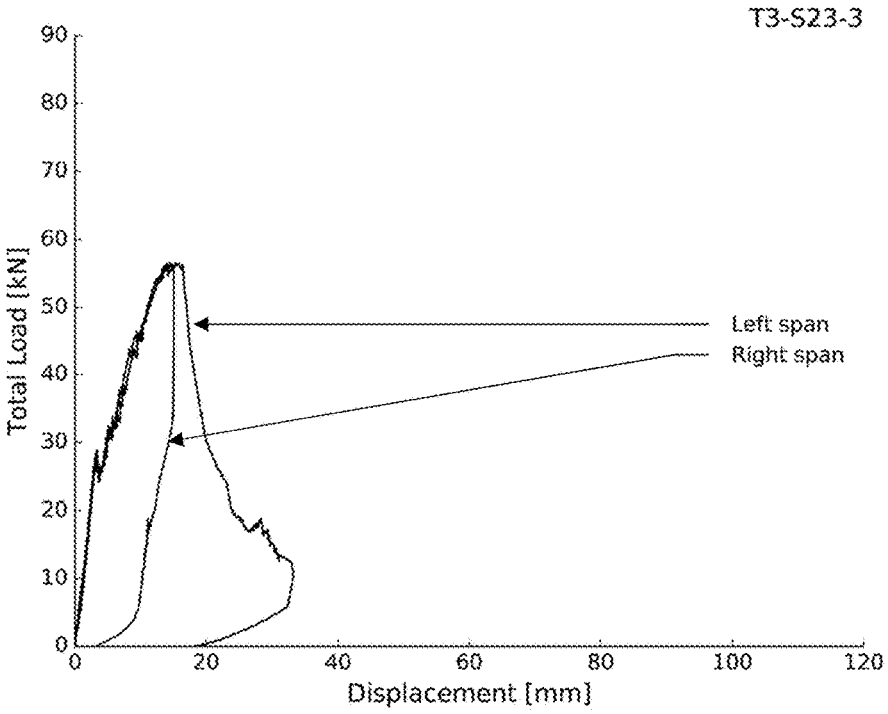
Figure 41:
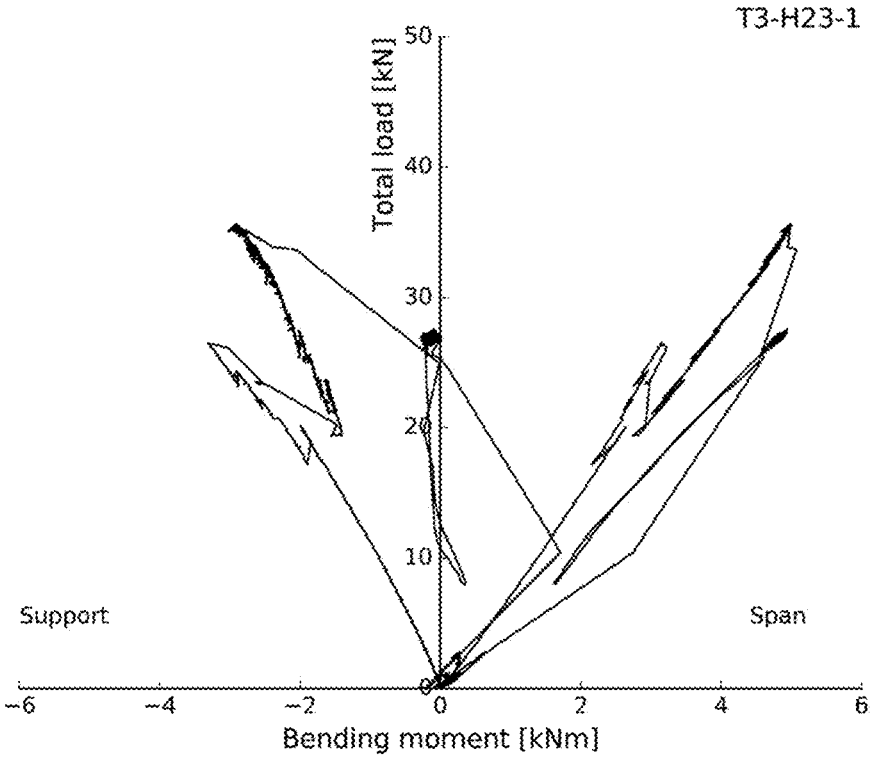
Figure 42:
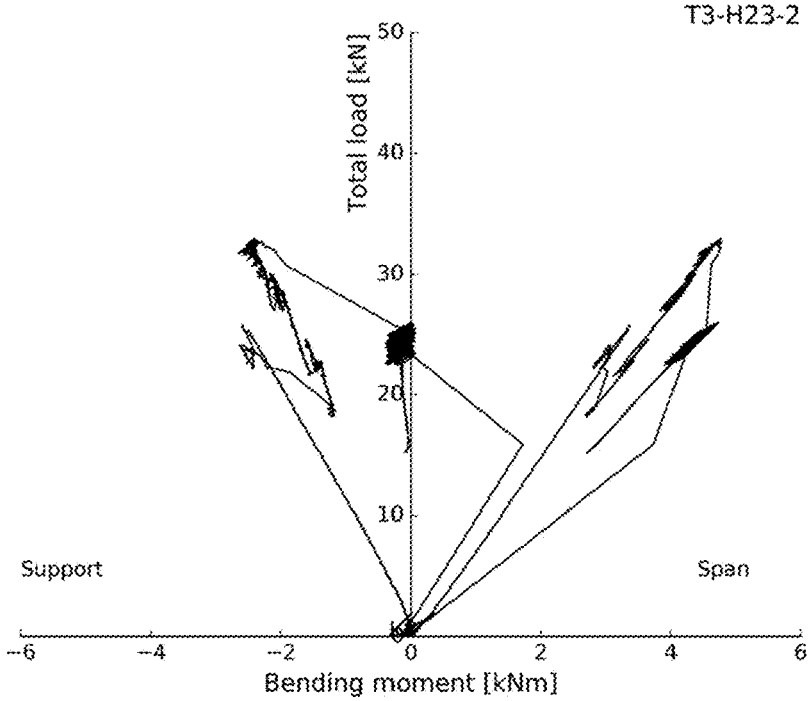
Figure 43:
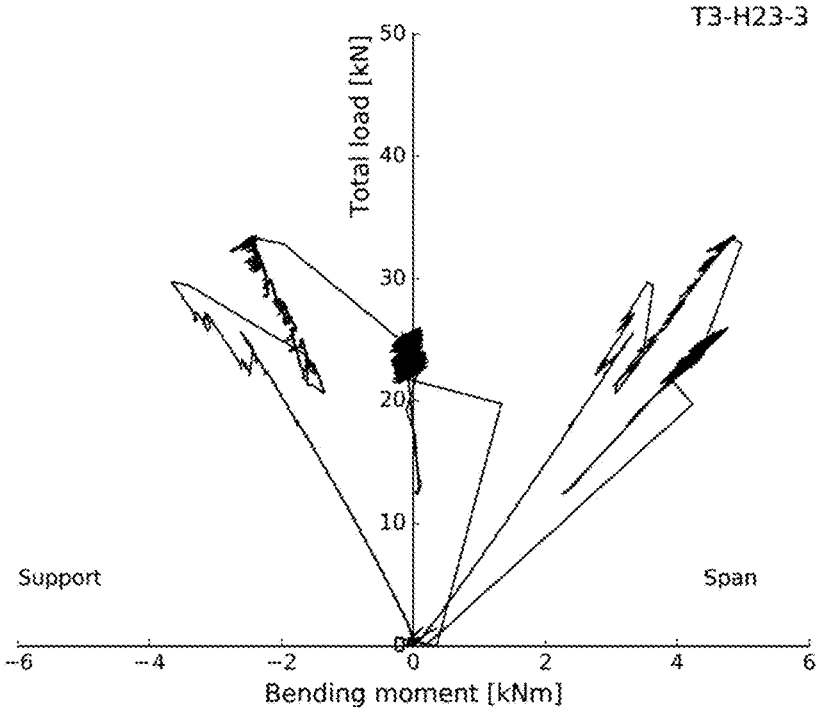
Figure 44:
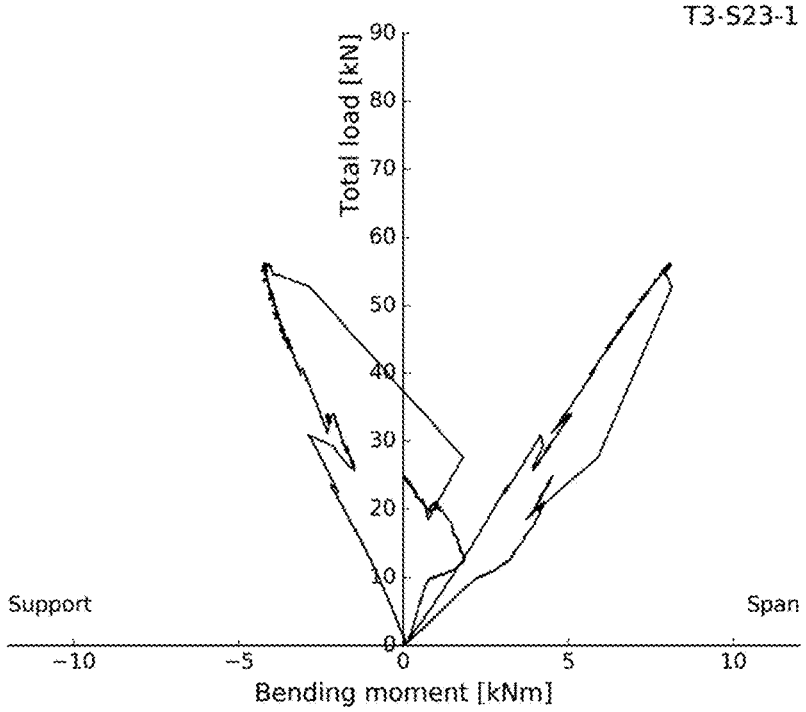
Figure 45:
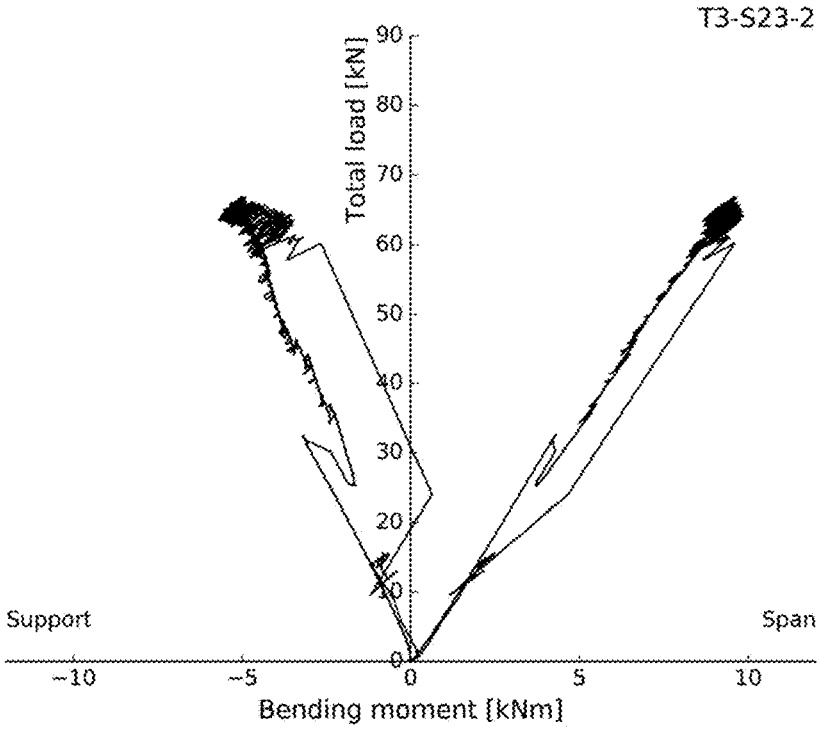
Figure 46:
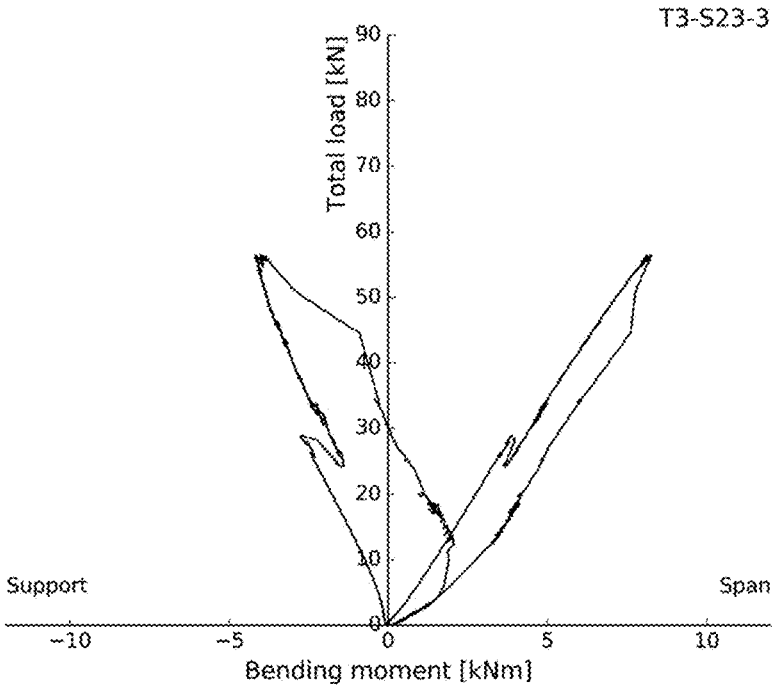

In FIG. 34, the positions of the actuator 344, the LVDTs 341 and load cells 342, together with the vertical supports, lateral supports 343, the loading beam 345 and load introduction points are schematically illustrated. As the central support illustrated a lower stiffness than the outer supports, the support is represented as a spring in FIG. 34.

Furthermore, the entire test specimen was captured by film and photo camera during testing. Also, three high-definition webcams were located at the central support and both spans to record the growing crack pattern and reinforcement yielding in the glass beam specimens.

After two weeks, the beams are preconditioned at 23° C. and 55% relative humidity in the climatic chamber containing the test setup, for one week. Once conditioned, the beam specimen is mounted into the test setup. The test itself starts with the lowering of the loading beam (by manually pushing out the actuator) so that the position of the U-pieces can be fine-tuned and sufficient oil pressure is present in the actuator. At this stage, the loading beam makes contact with the U-pieces on the beam. Subsequently, the test is started by activating the actuator in a displacement-controlled way, implementing a rate of 0.1 mm/s. This rate is continuously controlled by the pump station. Once the beam specimen has collapsed or its remaining load-carrying capacity has become insignificant, the test is stopped by manually deactivating the actuator with the pump station after which it returns to its original position by means of the pulley system.

After capturing the final shape of the tested beam specimen, it is removed from the test setup and a new beam specimen is placed after which the test procedure can be repeated. A typical procedure lasted about 60 minutes, of which the test itself took about 30 minutes.

For the displacement, the mean value of the recorded values in both spans was taken. Values for the initial failure load (corresponding to first glass fracture), ultimate capacity and post-fracture performance (i.e. ultimate capacity/initial failure load) are provided in the table hereinbelow.

| Series | | S-23 | H-23 |
|---|---|---|---|
| Initial Failure | Average (kN) | 28.10 | 23.86 |
| Load | St. Dev. (kN) | 4.52 | 3.26 |
| Ultimate Capacity | Average (kN) | 59.82 | 34.00 |
| | St. Dev. (kN) | 6.10 | 1.40 |
| Post-fracture | Average | 2.15 | 1.45 |
| performance | St. Dev. | 0.22 | 0.28 |

FIGS. 35 to 46 provide an overview of the load-displacement (FIGS. 35 to 40) and load-moment diagrams (FIGS. 41 to 46) obtained for the three solid reinforcement samples (FIGS. 38 to 40 and FIGS. 44 to 46) and the three hollow reinforcement samples (FIGS. 35 to 37 and FIGS. 41 to 43). For all beam specimens, generally four phases were observed during the tests: (1) the beams behaved linear elastically up to first glass fracture (corresponding to the initial failure load) at one of the zones suffering maximum bending moment; (2) fractures in the other midspan and/or central support zones directly followed and the glass beams further fractured near these zones up to the point where the reinforcement started to yield; (3) in case of the H-23 test series, the reinforcement sections yielded further, forming plastic hinges at the central support and midspan zones, resulting in ductile behaviour. Then the weld failed, giving rise to a significant load redistribution towards both spans, where the two plastic hinges further deformed until one of the tensile reinforcement sections failed. In case of the S-23 test series, bond failure between the reinforcement and the cast resin occurred before the reinforcement could yield. As a result, the beams illustrated shear failure at the 10 mm glass pane contact zone and the reinforcement was pushed out of the beam section. Both concepts illustrated safe failure behaviour, as significant post-fracture strength was achieved, with post-fracture performances of 2.15 and 1.45 for respectively the solid and hollow profile reinforced specimens.

Figure 47:
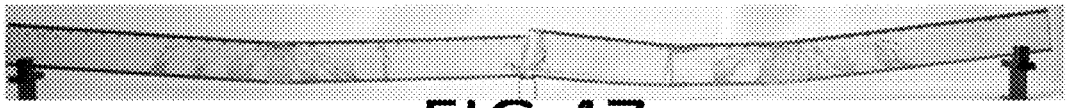
FIGS. 47 to 49 show pictures, after failure, of the three hollow reinforcement samples, in an example experiment relating to embodiments of the present invention.
Figure 48:
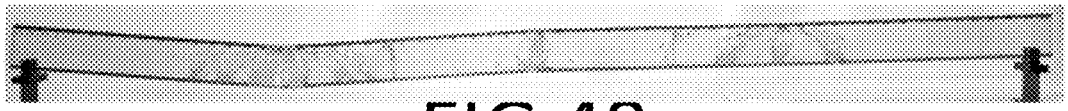
Figure 49:
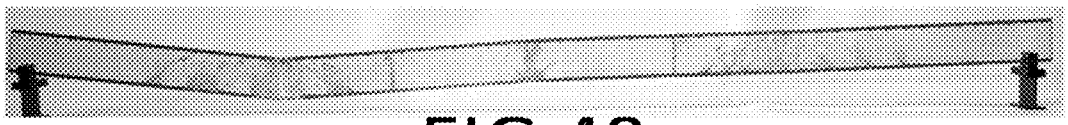
Figure 50:
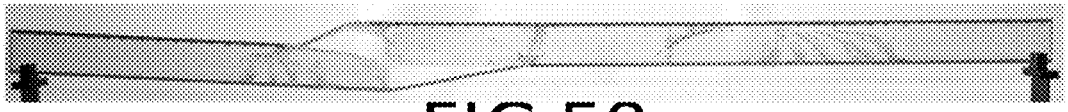
FIGS. 50 to 52 show pictures, after failure, of the three solid reinforcement samples, in an example experiment relating to embodiments of the present invention.
Figure 51:
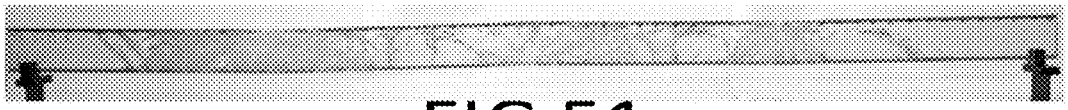
Figure 52:
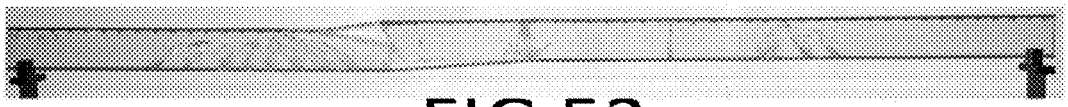

FIGS. 47 to 49 respectively show pictures of the final shapes of the three hollow reinforcement samples, and FIGS. 50 to 52 respectively show pictures of the final shapes of the three solid reinforcement samples.

The invention claimed is:

1. A glass beam element for constructing a loadbearing structure, the glass beam element comprising:

at least one elongate structural reinforcement section extending along a longitudinal direction; and at least one glass segment bonded to said at least one elongate structural reinforcement section;

wherein the at least one elongate structural reinforcement section comprises a weldable material;

wherein said at least one glass segment has a length along said longitudinal direction that is shorter than the elongate structural reinforcement section such as to allow welding of an end region of the at least one elongate structural reinforcement section without thereby damaging the at least one glass segment.

2. The glass beam element of claim 1, wherein said at least one structural reinforcement section extends for a first distance beyond the at least one glass segment in at least one sense of the longitudinal direction, said first distance being at least 4 times a largest diameter of a cross section of the structural reinforcement section.

3. The glass beam element of claim 1, in which said at least one glass segment is bonded to said at least one elongate structural reinforcement section in a region of the glass beam element that comprises at least part of an edge of the glass segment, wherein said glass segment has a rectangular planar shape and said edge corresponds to a long edge of the rectangular planar shape.

4. The glass beam element of claim 3, wherein said at least one elongate structural reinforcement section comprises two parallel elongate structural reinforcement sections extending along the longitudinal direction, wherein the at least one glass segment is bonded along both long edges of said rectangular planar shape to respectively said two elongate structural reinforcement sections, wherein said at least one glass segment has a length along said longitudinal direction that is shorter than both elongate structural reinforcement sections such as to allow welding of end regions of both elongate structural reinforcement sections without thereby damaging the at least one glass segment.

5. The glass beam element of claim 4, wherein said at least one glass segment comprises at least one internal glass pane and two external glass panes, said internal glass pane being provided in between said two parallel elongate structural reinforcement sections and in between said two external glass panes, said two external glass panes furthermore extending over the two elongate structural reinforcement sections such as to position the two elongate structural reinforcement sections in between the two external glass panes.

6. The glass beam element of claim 5, wherein the at least one internal glass pane is longer in said longitudinal direction than each of said two external glass panes.

7. The glass beam element of claim 6, wherein said first distance corresponds to a distance that each structural reinforcement section extends beyond the at least one internal glass pane in said longitudinal direction, and wherein each structural reinforcement section extends beyond each external glass pane in the longitudinal direction over a second distance, in which this second distance is larger than the first distance.

8. A method for constructing a loadbearing structure, the method comprising:

obtaining a first glass beam element and a second glass beam element, wherein each of the first glass beam element and the second glass beam element comprises:

at least one elongate structural reinforcement section extending along a longitudinal direction; and at least one glass segment bonded to said at least one elongate structural reinforcement section;

wherein the at least one elongate structural reinforcement section comprises a weldable material;

wherein said at least one glass segment has a length along said longitudinal direction that is shorter than the elongate structural reinforcement section such as to allow welding of an end region of the at least one elongate structural reinforcement section without thereby damaging the at least one glass segment;

placing said end region of said at least one elongate structural reinforcement section of said first glass beam element such as to abut said end region of said at least one elongate structural reinforcement section of said second glass beam element;

welding said end region of said at least one elongate structural reinforcement section of said first glass beam element to said end region of said at least one elongate structural reinforcement section of said second glass element such as to obtain at least one joined elongate structural reinforcement section;

bonding at least one connection glass segment to said at least one joined elongate structural reinforcement section such as to form a substantially continuous glass surface formed by the at least one glass segment of the first glass beam element, the at least one connection glass segment and the at least one glass segment of the second glass beam element.

9. The method of claim 8, wherein said welding comprises performing a circumferential weld of hollow profiles of said at least one structural reinforcement sections in said abutting end regions.

10. The method of claim 9, wherein a continuous duct for a cable and/or a conduit is provided throughout the at least one joined elongate structural reinforcement section formed by said circumferential welding of the at least one elongate structural reinforcement sections.

11. The method of claim 8, further comprising polishing a weld surface produced by said welding before performing said bonding.

12. The method of claim 8, wherein said obtaining comprises obtaining said first and said second glass beam element, in which each of the first glass beam element and the second glass beam element comprises at least one internal glass pane and two external glass panes, said internal glass pane being provided in between two parallel elongate structural reinforcement sections and in between said two external glass panes, said two external glass panes furthermore extending over the two elongate structural reinforcement sections such as to position the two elongate structural reinforcement sections in between the two external glass panes;

wherein said placing comprises placing two first end regions of respectively said two parallel elongate structural reinforcement sections of said first glass beam element such as to respectively abut two second end regions of respectively said two parallel elongate structural reinforcement sections of said second glass beam element, said two first end regions and said two second end regions being at a same end of respectively the first glass beam element and the second glass beam element with respect to said longitudinal direction of the corresponding glass beam element;

wherein said welding comprises welding said two first end regions to respectively said two second end regions such as to obtain two joined elongate structural reinforcement sections;

wherein said bonding comprises assembling glass panes by placing an internal connection glass pane in between said internal glass pane of said first glass beam element and said internal glass pane of said second glass beam element and in between said two joined elongate structural reinforcement sections;

wherein said assembling further comprises placing two external connection glass panes respectively on either side of said internal connection glass pane, said two external connection glass panes furthermore extending over the two joined elongate structural reinforcement sections such as to position the two joined elongate structural reinforcement sections in between the two external connection glass panes.

13. The method of claim 12, wherein said bonding further comprises providing an adhesive film in between each external connection glass pane and said internal connection glass pane and/or in between each external connection glass pane and said internal glass panes.

14. The method of claim 12, wherein said assembling further comprises:

spacing said internal connection glass pane away from the at least one internal glass panes of respectively the first and second glass beam element;

spacing said external connection glass panes away from the external glass panes of respectively the first and second glass beam element; and spacing said internal connection glass pane away from said external connection glass panes, such as to avoid direct glass to glass contact between said glass panes;

and wherein said bonding further comprises filling spaces in between said assembled glass panes with a liquid adhesive wherein said spaces are formed by said spacing.

15. The method of claim 14, wherein said liquid adhesive comprises a cast resin that cures under the influence of ultraviolet radiation, and wherein said bonding further comprises exposing the assembled glass panes to ultraviolet radiation in order to cure said cast resin.

16. A loadbearing structure comprising at least one connection glass segment and at least a first and a second glass beam element, wherein each of the first glass beam element and the second glass beam element comprises at least one elongate structural reinforcement section extending along a longitudinal direction and at least one glass segment bonded to said at least one elongate structural reinforcement section, wherein the at least one elongate structural reinforcement section comprises a weldable material, wherein said at least one glass segment has a length along said longitudinal direction that is shorter than the elongate structural reinforcement section such as to allow welding of an end region of the at least one elongate structural reinforcement section without thereby damaging the at least one glass segment, wherein said end region of said at least one elongate structural reinforcement section of said first glass beam element is welded to said end region of said at least one elongate structural reinforcement section of said second glass beam element such as to form at least one joined elongate structural reinforcement section, wherein said at least one connection glass segment is bonded to said at least one joined elongate structural reinforcement section such as to form a substantially continuous glass surface formed by the at least one glass segment of the first glass beam element, the at least one connection glass segment and the at least one glass segment of the second glass beam element.

17. A loadbearing structure comprising at least one connection glass segment and at least a first and a second glass beam element, wherein each of the first glass beam element and the second glass beam element comprises at least one elongate structural reinforcement section extending along a longitudinal direction and at least one glass segment bonded to said at least one elongate structural reinforcement section, wherein the at least one elongate structural reinforcement section comprises a weldable material, wherein said at least one glass segment has a length along said longitudinal direction that is shorter than the elongate structural reinforcement section such as to allow welding of an end region of the at least one elongate structural reinforcement section without thereby damaging the at least one glass segment, wherein said end region of said at least one elongate structural reinforcement section of said first glass beam element is welded to said end region of said at least one elongate structural reinforcement section of said second glass beam element such as to form at least one joined elongate structural reinforcement section, wherein said at least one connection glass segment is bonded to said at least one joined elongate structural reinforcement section such as to form a substantially continuous glass surface formed by the at least one glass segment of the first glass beam element, the at least one connection glass segment and the at least one glass segment of the second glass beam element;

wherein each of said first and second glass beam element comprise at least one internal glass pane and two external glass panes, said internal glass pane being provided in between two parallel elongate structural reinforcement sections and in between said two external glass panes, said two external glass panes furthermore extending over the two elongate structural reinforcement sections such as to position the two elongate structural reinforcement sections in between the two external glass panes;

wherein said at least one connection glass segment comprises an internal connection glass pane in between two external connection glass panes;

wherein said internal connection glass pane is located in between said internal glass pane of said first glass beam element and said internal glass pane of said second glass beam element;

wherein said internal connection glass pane is located in between said two joined elongate structural reinforcement sections;

wherein said internal connection glass pane is located in between said two external connection glass panes;

wherein said two external connection glass panes extend over the two joined elongate structural reinforcement sections such as to position the two joined elongate structural reinforcement sections in between the two external connection glass panes;

wherein said internal connection glass pane is separated from and bonded to said two external connection glass panes by layers formed by adhesive films.

* * * * *